US008168363B2

(12) United States Patent
Imura et al.

(10) Patent No.: US 8,168,363 B2
(45) Date of Patent: May 1, 2012

(54) TONER AND PRODUCING METHOD THEREOF, DEVELOPER, TWO-COMPONENT DEVELOPER, DEVELOPING DEVICE AND IMAGE FORMING APPARATUS

(75) Inventors: Yasuo Imura, Tenri (JP); Hiroshi Onda, Yamatokoriyama (JP); Yoritaka Tsubaki, Nara (JP); Saori Yamada, Neyagawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 527 days.

(21) Appl. No.: 12/351,129

(22) Filed: Jan. 9, 2009

(65) Prior Publication Data

US 2009/0180809 A1 Jul. 16, 2009

(30) Foreign Application Priority Data

Jan. 10, 2008 (JP) ..... P2008-003747

(51) Int. Cl.
*G03G 5/00* (2006.01)

(52) U.S. Cl. ..... 430/110.3; 430/108.1; 430/110.4

(58) Field of Classification Search ..... 430/108.1, 430/109.1, 110.1, 110.3, 110.4, 111.1, 111.4
See application file for complete search history.

(56) References Cited

U.S. PATENT DOCUMENTS

| | | | | |
|---|---|---|---|---|
| 5,774,771 | A * | 6/1998 | Kukimoto et al. | 430/45.54 |
| 6,238,834 | B1 | 5/2001 | Tamura et al. | |
| 2006/0068314 | A1* | 3/2006 | Kawata | 430/110.4 |
| 2007/0020552 | A1 | 1/2007 | Matsumoto et al. | |
| 2009/0123186 | A1* | 5/2009 | Sugiura et al. | 399/223 |

FOREIGN PATENT DOCUMENTS

| | | | |
|---|---|---|---|
| CN | 101004564 | A | 7/2007 |
| JP | 8-220794 | | 8/1996 |
| JP | 11-194533 | A | 7/1999 |
| JP | 2003-280239 | A | 10/2003 |
| JP | 2004-271795 | A | 9/2004 |
| JP | 2005-3751 | | 1/2005 |
| JP | 2005-242212 | | 9/2005 |
| JP | 2005-257976 | | 9/2005 |

* cited by examiner

*Primary Examiner* — Mark F Huff
*Assistant Examiner* — Stewart Fraser
(74) *Attorney, Agent, or Firm* — Nixon & Vanderhye P.C.

(57) ABSTRACT

A toner is so configured as to satisfy the following conditions: (b)/(a) is from 0.90 to 1.02, (a) is from 140 to 150 and the average value in the entire toner particles of a shape factor SF-2 of the toner particles is larger than 140, where (a) represents a shape factor SF-2 showing the degree of irregularity on the surface of toner particles having a particle size $D_{75V}$ or less which is a particle size at which a cumulative volume from a large particle size side in particle size distribution by volume is 75%, and (b) represents a shape factor SF-2 of toner particles having a particle size $D_{25V}$ or more which is a particle size at which a cumulative volume from a large particle size side in particle size distribution by volume is 25%.

8 Claims, 6 Drawing Sheets

TONER AND PRODUCING METHOD THEREOF, DEVELOPER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2008-003747, which was filed on Jan. 10, 2008, the contents of which are incorporated herein by reference, in their entirety.

BACKGROUND OF THE INVENTION

1. Field of the Invention

The present invention relates to a toner and a producing method thereof, a developer, a two-component developer, a developing device and an image forming apparatus.

2. Description of the Related Art

A toner developing a latent image is used in a variety of image forming processes. As one of the examples, it is known that the toner is used in an image forming process of an electrophotographic system.

An image forming apparatus of the electrophotographic system is conventionally prevalent as a copying machine, and recently has excellent properties as an output apparatus of a computer image created by a computer. Accordingly, as the computer prevails, the image forming apparatus thereof is also widely used in a printer, a facsimile apparatus and the like. The image forming apparatus of the electrophotographic system is a apparatus for forming a desirable image on a recording medium by performing a charging step of uniformly charging, for example, a photoreceptor layer on a surface of a photoreceptor drum, an exposing step of forming an electrostatic latent image on the charged surface of the photoreceptor drum by projecting signal lights of a document image thereon, a developing step of supplying an electrophotographic toner (hereinafter, simply referred as "toner") to the electrostatic latent image on the surface of the photoreceptor drum so as to visualize the electrostatic latent image, a transferring step of transferring the visualized image on the surface of the photoreceptor drum onto the recording medium such as sheet and viewgraph, a fixing step of fixing the visualized image on the recording medium through heating, pressurization and the like, and a cleaning step of cleaning the surface of the photoreceptor drum after transferring the visualized image by removing the toner and the like remaining thereon by means of a cleaning blade. The visualized image may also be transferred on the recording medium through an intermediate transfer medium.

Due to a further advancement of a variety of techniques as to the computer, for example, due to an advancement of high-definition of the computer image, the image forming apparatus of the electrophotographic system is also required to correctly and distinctly duplicate a fine figure, a subtle hue change and the like in the computer image, and to form a high-definition image comparable to the computer image. In order to meet the requirement, for example, reduction of toner particle size has been intended, where a variety of considerations have been carried out for producing a toner whose particle size is about 5 μm which is useful for the high-definition of the image.

Although such a reduced particle size toner is useful for forming the high-definition image, the toner encompasses a lot of fine powders so that there is a disadvantage in that transferring efficiency is low. The reduced particle size toner has high charge-accumulation property and a large specific surface area compared to a toner for example whose particle size is more than 5 μm, so that adhesiveness of the reduced particle size toner to the photoreceptor drum and the intermediate transfer medium is strong. The reduced particle size toner has the low transferring efficiency and is hard to be transformed to the recording medium, causing a problem that, when the reduced particle size toner is used, an amount of the toner remaining on the photoreceptor drum and the intermediate transfer medium after transferring the visualized images onto the recording medium is increased.

In view of such a problem, it is suggested that, by spheroidizing the toner, a contact area between the photoreceptor drum and the intermediate transfer medium, and the toner is so reduced that the transferring efficiency of the toner is enhanced (referring to Japanese Examined Patent Publication JP-B2 3253228 and Japanese Unexamined Patent Publication JP-A 2005-257976, for example).

In JP-B2 3253228, it is disclosed that, by defining the shape coefficient SF-1 indicating the degree of roundness of a toner particle as 111 to 160, the shape coefficient SF-2 indicating the degree of irregularity of a surface of the toner particle as 110 to 140, SF-2/SF-1 as 1 or less, and the content of releasing agent as 5 to 40%, the toner particle can be transferred from a photoreceptor and an intermediate photoreceptor at a high transfer ratio, and the toner which does not cause melt-bonding of the toner and filming is obtained.

In JP-A 2005-257976, it is disclosed that, by defining the degree of circular of the toner particle as 95 or more, the shape coefficient SF-2 thereof as 120 to 150, resistance thereof as $5\times10^{7}$ to $3\times10^{11}$ Ω·cm, the toner which can achieve a balance among improvement of transferability (reduction of the transfer remaining toner), ungeneration of transfer struggle (prevention of abnormal image generation) and good cleanability, and which can form a high-definition image is obtained.

When the toner particle constituting the toner has irregularity of the surface, that is the toner particle has irregular shape, the toner particle has a tendency to be caught by the cleaning blade so that the cleanability is made good, but the transferability to the recording medium is so low that the high-definition image is not stably formed. When the toner particle becomes nearly spherical shape, the transferability is elevated, but the toner particle is so hard to be caught by the cleaning blade that the cleanability degrades. Therefore, in a spheroidizing technique of the toner, the toner design which has both the transferability and the cleanability at high level and which can respond to the high-definition of the image is required.

The toner disclosed in JP-B2 3253228 and JP-A 2005-257976 is intended to keep both the cleanability and the transferability at high level by controlling the degree of the roundness of the all toner particles and an average value of the shape coefficient indicating the degree of the irregularity of the surface thereof in a constant range so as to control an averaged shape of the all toner particles in a constant range, and further by defying both the content of the releasing agent and a resistance value of the toner.

However, behavior of the toner particles is different from each other due to the particle size, so that when the shape of the all toner particles are defined to be averaged, the smaller the size of the toner particle becomes, the worse the cleanability gets. It is good for the cleanability that the degree of the irregularity of the surface of the toner particle is larger, however, from, the point of view of the fixation, it is not preferable. The higher the degree of the irregularity of the surface of the toner particle becomes, the larger the space between the toner particles gets, so that the heat conductivity between the toner particles degrades, causing negative effect on the fixation. That is, the heat conductivity between the toner particles degrades so that the required temperature for the fixation rises. The effect of the degree of the irregularity of the surface on the heat conductivity rises as the size of the toner particle increases.

Although the so-called struggle caused when the toner flies to the portion to be white of an image bearing member such as the photoreceptor can be prevented or suppressed by controlling the shape of the toner, the struggle caused by the larger size of the toner particle is so remarkable that it is important to prevent the struggle of the large size of the toner particle.

Thus, for a toner property, the balance between the size of the toner particle and the shape thereof is important. However, in the art disclosed in JP-B2 3253228 and JP-A 2005-257976, the effect of the size of the toner particle is not evaluated.

SUMMARY OF THE INVENTION

The invention has been made in view of the problems, and its object is to provide a toner having good cleanability and fixability, having suppressed generation of scattering and capable of forming high quality images free of fogging, a method for producing the toner, a developer, a two-component developer, a developing device, and an image forming apparatus.

The invention provides a toner comprising a plurality of toner particles each at least containing a binder resin and a colorant, wherein (a) and (b) are satisfied with the following expressions (1) and (2):

$$0.90 \leqq (b)/(a) \leqq 1.02 \quad (1)$$

$$140 \leqq (a) \leqq 150 \quad (2)$$

where (a) represents a shape factor SF-2 showing a degree of irregularity on surfaces of toner particles having a particle size $D_{75V}$ or less which is a particle size at which a cumulative volume from a large particle size side in particle size distribution by volume is 75%, and (b) represents a shape factor SF-2 of toner particles having a particle size $D_{25V}$ or more which is a particle size at which a cumulative volume from a large particle size side in particle size distribution by volume is 25%, and wherein an average value in an entire toner particles of the shape factor SF-2 of the toner particles is larger than 140.

According to the invention, the toner comprises a plurality of toner particles each at least containing a binder resin and a colorant. When (a) represents a shape factor (sometimes referred to as "irregularity shape factor") SF-2 showing the degree of irregularity on the surface of toner particle having a particle size $D_{75V}$ or less which is a particle size (sometimes referred to as "75% particle size) at which a cumulative volume from a large particle size side in particle size distribution by volume is 75%, and (b) represents a shape factor SF-2 of toner particles having a particle size $D_{25V}$ or more which is a particle (sometimes referred to as "25% particle size") at which a cumulative volume from a large particle size side in particle size distribution by volume is 25%, (a) and (b) are satisfied with the expressions (1) and (2), and the average value in the entire toner particles of the shape factor SF-2 of the toner particles is larger than 140.

(a) represents the irregularity shape factor SF-2 of the toner particles having a particle size of 75% particle size $D_{75V}$ or less, that is, toner particles having a small particle size, and (b) represents the irregularity shape factor SF-2 of the toner particles having a particle size of 25% particle size $D_{25V}$ or more, that is, toner particles having a large particle size. Where (a) and (b) are not satisfied with the expression (1) and (b)/(a) is less than 0.9, the degree of irregularity on the surface of the toner particles having a large particle size is too small as compare with the degree of irregularity on the surface of the toner particles having a small particle size. As a result, balance between physical adhesion and chargeability is lost between the toner particles, and a so-called selective development that only toner particles having a specific particle size in a toner are selectively used in development is generated. Furthermore, where (b)/(a) exceeds 1.02, even though (a) is satisfied with the expression (2), the value of (b) is excessively large, and irregularity on the surface of toner particles having a large particle size is excessively increased. As a result, distribution of charging amount on the surface of toner particles becomes heterogeneous, and a so-called scattering that a toner is adhered on an area to be a white background area of a recording medium is generated. The toner particles having a large particle size are larger than the toner particles having a small particle size, and therefore become marked when scattered.

When (b)/(a) is satisfied with the expression (1) as described above, the degree of irregularity on the surface of the toner particles having a large particle size can be prevented from being excessively small, as compared with the degree of irregularity on the surface of the toner particles having a small particle size. As a result, balance between physical adhesion and chargeability is maintained between toner particles, thereby selective development can be prevented from being generated. Furthermore, the value of (b) is prevented from being excessively large, and the irregularity on the surface of the toner particles having a large particle size is prevented from being excessively increased. As a result, variation of distribution of charging amount on the surface of toner particles is suppressed, and generation of scattering can be suppressed. When toner particles are laminated on the surface of a paper in a fixing step, space between toner particles is decreased as the irregularity on the surface of toner particles becomes less. This brings about excellent thermal conductivity and is useful in low temperature fixing. When comparison is made between particles having the same shape but having different particle size, particles having a large particle size increase a size of space between toner particles, and as a result, the effect of low temperature fixing is remarkably developed. Therefore, when (b)/(a) is satisfied with the expression (1) to thereby preventing the value of (b) being excessively increased, the irregularity of the toner particles having a large particle size can be prevented from being excessively increased, and a size of space between toner particles can be decreased. As a result, a toner having excellent thermal conductivity and low temperature fixability can be achieved.

The toner particles decrease cleanability with decreasing its particle size. However, decrease in cleanability can be prevented by increasing irregularity on the surface of toner particles. Where (a) is not satisfied with the expression (2) and (a) is less than 140, irregularity on the surface of the toner particles having a small particle size is excessively decreased, and as a result, sufficient cleanability is not obtained. When (a) is 140 or more, the irregularity on the surface of the toner particles having a small particle size is increased, thereby good cleanability can be obtained as the entire toner particles. On the other hand, where (a) exceeds 150, the irregularity on the surface of the toner particles having a small particle size is excessively increased, and transfer efficiency is decreased.

When (a) is satisfied with the expression (2), the degree of irregularity on the surface of the toner particles having a small size is made to be suitable, and good cleanability and transferability can be achieved.

When the average value in the entire toner particles of the irregularity shape factor SF-2 is 140 or less, there is no problem on cleanability when the number of image formation is small. However, where the number of image formation is increased, for example, exceeds 50,000, cleaning defect begins to be generated. As described above, when the average value in the entire toner particles of the irregularity shape factor SF-2 is larger than 140, cleaning defect due to the increase in the number of image formation can be suppressed from being generated.

From the above, according to the toner of the invention, high quality images can stably be formed.

Furthermore, in the invention, it is preferable that the average value in the entire toner particles of a shape factor SF-1 showing a degree of roundness of toner particles is not less than 150 and not more than 160.

According to the invention, the average value in the entire toner particles of a shape factor (sometimes referred to as "roundness shape factor") SF-1 of toner particles is not less than 150 and not more than 160. Where the average value in the entire toner particles of the roundness shape factor SF-1 is smaller than 150, sufficient cleanability may not be obtained, and where the average value is larger than 160, sufficient transfer efficiency may not be obtained. As described above, when the roundness shape factor SF-1 is not less than 150 and not more than 160, good cleanability and good transfer efficiency can be achieved.

In the invention, it is preferable that a volume average particle size in the entire toner particles is from 4 to 8 μm.

According to the invention, a volume average particle size in the entire toner particles is from 4 to 8 μm. Where the volume average particle size in the entire toner particles is smaller than 4 μm, scattering of a toner and fogging of an image are liable to be generated, and cleaning defect may be generated. On the other hand, where the volume average particle size in the entire toner particles is larger than 8 μm, high definition images cannot be formed. As described above, when the volume average particle size in the entire toner particles is from 4 to 8 μm, scattering of a toner and fogging of images can be suppressed from being generated, and cleaning defect can be prevented from being generated. Furthermore, high definition images can be formed.

In the invention, it is preferable that each of toner particles contains a release agent, and the release agent is contained by an amount of from 3 to 10% by weight based on the total weight of the toner.

According to the invention, each of toner particles contains a release agent, and the release agent is contained by an amount of from 3 to 10% by weight based on the total weight of the toner. Where the content of the release agent is smaller than 3% by weight, good releasability may not be obtained when fixing a toner to a recoding medium. On the other hand, where the content of the release agent is larger than 10% by weight, flowability of a toner may deteriorate. Furthermore, good fixing strength may not be obtained. Additionally, fusion between toner particles and filming of a toner to an image bearing member or the like may be generated. As described above, when the content of the release agent is from 3 to 10% by weight, the toner shows good releasability when fixed. Furthermore, decrease in flowability of a toner, fusion between toner particles and filming of a toner to an image bearing member or the like can be prevented.

The invention further provides a method for producing the toner mentioned above, comprising:

a melt-kneading step of kneading a toner raw material comprising a binder resin and a colorant in a state that the binder resin is melted, thereby forming a kneaded material;

a pulverization step of pulverizing a solidified product of the kneaded material formed in the melt-kneading step to obtain a first pulverized material comprising a plurality of toner particles and a second pulverized material comprising a plurality of toner particles and having a volume average particle size of the toner particles larger than that of the first pulverized material;

a first classification step of classifying the first pulverized material obtained in the pulverization step to obtain a first toner particle group;

a spheronization step of spheronizing the toner particles constituting the second pulverized material obtained in the pulverization step;

a second classification step of classifying the second pulverized material having the spheronized toner particles to obtain a second toner particle group having a volume average particle size larger than that of the first toner particle group; and a mixing step of mixing the first toner particle group obtained in the first classification step and the second toner particle group obtained in the second classification step.

According to the invention, in the melt-kneading step, the toner raw material comprising a binder resin and a colorant are kneaded in the state that the binder resin melts, thereby a kneaded material is formed. A solidified product of the kneaded material formed is pulverized in the pulverization step, thereby the first pulverized material and the second pulverized material having a volume average particle size of toner particles larger than that of the first pulverized material. The first pulverized material obtained in the pulverization step is classified in the first classification step, thereby the first toner particle group is obtained. The second pulverized material obtained in the pulverization step is classified in the second classification step after the toner particles are spheronized in the spheronization step, thereby the second toner particle group having a volume average particle size larger than that of the first toner particle group. The thus obtained first toner particle group and second toner particle group are mixed in the mixing step, thereby the toner of the invention is obtained. This method can produce the toner of the invention in which the toner particles having a large particle size and the toner particles having a small particle size can be controlled into an appropriate shape, respectively.

In the invention, it is preferable that mechanical impact force is applied to the toner particles constituting the second pulverized material to spheronize the toner particles in the spheronization step.

According to the invention, the toner particles constituting the second pulverized material are spheronized by applying mechanical impact force thereto in the spheronization step. This can spheronize the toner particles constituting the second pulverized material while appropriately giving irregularity to the surface of the toner particles. Therefore, the toner of the invention can easily be obtained. In the case that the toner material contains a release agent, where spheronization is conducted by applying heat, decrease in flowability of a toner, fusion between the toner particles and filming of a toner to an image bearing member or the like may be generated by the bleeding of the release agent. As described above, when the spheronization is conducted by applying mechanical impact force, the release agent can be prevented from bleeding. As a result, decrease in flowability of a toner, fusion between the toner particles and generation of filming of a toner to an image bearing member or the like can be prevented.

The invention provides a developer comprising the toner mentioned above.

According to the invention, the developer is constituted by containing the excellent toner of the invention as mentioned above. The toner of the invention is that the individual toner particles are appropriately charged. Therefore, generation of fogging to a white background area of a recording medium can be prevented, and additionally, selective development and generation of scattering can be prevented. Furthermore, the toner of the invention is excellent in cleanability and transferability. Therefore, use of the developer of the invention can form high quality images.

The invention provides a two-component developer comprising the toner mentioned above and a carrier.

According to the invention, A two-component developer comprises the excellent toner of the invention as mentioned above and a carrier. The toner of the invention is that the individual toner particles can appropriately be charged by the carrier. Therefore, the toner can prevent generation of fogging on a white background area of a recording medium and can further prevent selective development and generation of scattering. As a result, high quality images can be formed.

The invention provides a developing device which forms a toner image by developing a latent image formed on an image bearing member, using the developer mentioned above or the two-component developer mentioned above.

According to the invention, the developing device forms a toner image by developing a latent image formed on an image bearing member, using the excellent developer of the invention as mentioned above. By this developing device, fogging to an area to be a white background area on an image bearing member can be prevented, thereby forming high quality toner images.

The invention provides an image forming apparatus comprising:

an image bearing member on which a latent image is formed;

a latent image forming section which forms a latent image on the image bearing member; and the developing device mentioned above.

According to the invention, a latent image is formed on an image bearing member by a latent image forming section, and the latent image is developed with the excellent developing device of the invention, thereby forming a toner image. This can form high quality images free of fogging to a white background area of a recording medium.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
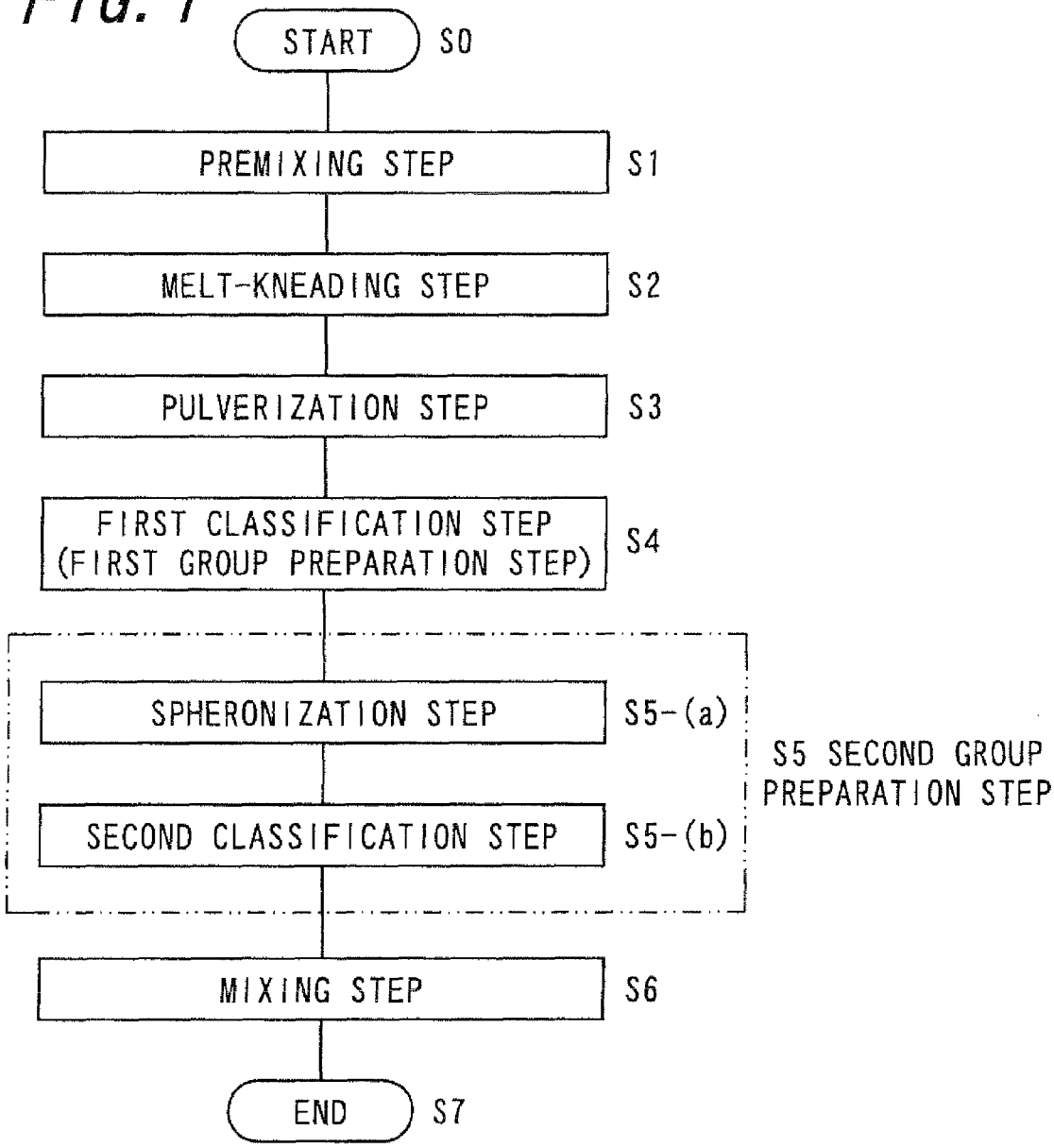
FIG. 1 is a flow chart showing one example of the procedures of a method for producing a toner according to an embodiment of the invention.

Now referring to the drawings, preferred embodiments of the invention are described below.

The toner as one embodiment of the invention comprises a plurality of toner particles, wherein (a) and (b) are satisfied with the following expressions (1) and (2):

$$0.90 \leqq (b)/(a) \leqq 1.02 \quad (1)$$

$$140 \leqq (a) \leqq 150 \quad (2)$$

where (a) represents a shape factor SF-2 showing the degree of irregularity on the surface of toner particles having a particle size $D_{75V}$ or less which is a particle size at which a cumulative volume from a large particle size side in particle size distribution by volume is 75%, and (b) represents a shape factor SF-2 of toner particles having a particle size $D_{25V}$ or more which is a particle size at which a cumulative volume from a large particle size side in particle size distribution by volume is 25%, and wherein the average value of the shape factor SP-2 in the entire toner particles of the toner particles is larger than 140.

In an electrophotographic process, one of the characteristics that a toner should be satisfied is cleanability of transfer residual toner on a photoreceptor or on a transfer belt in a transfer process. The cleanability is greatly influenced by a shape and a particle size of toner particles. The cleanability tends to become worse as a shape of toner particles is close to a sphere and as a particle size is decreased.

In the transfer process, the charged toner is transferred from one to other, for example, from a photoreceptor to a recoding medium, by external electric field. At that time, when scattering of charging distribution is present on the surface of toner particles, force does not properly transmit to a direction of electric field, and fails to attain the orbit, resulting in generation of a toner adhered on a non-image area, that is, a white background area. The toner adhered on the non-image area forms scattering, resulting in deterioration of an image. Charging distribution on the surface of toner particles is greatly influenced by a shape of a toner. Where many irregularities are present on the surface of the toner particles, the surface of the toner particles cannot evenly be contacted at the time of contact frictional charging, and electric charge is concentrated, resulting in scattering of charging distribution.

One of the important characteristics of a toner is fixability to a recording medium. In the fixing process, a toner is melted by heat quantity from a heat medium such as a fixing roller or a fixing belt, and fixed to a recording medium. In this fixing process, the shape of toner particles affects the fixability. Where toner particles have a shape having many irregularities on the surface thereof, a space size between toner particles and between a toner and a recording medium is increased, and thermal conductivity when fixed deteriorates, thereby low temperature fixability is decreased. This phenomenon is remarkable in the case that toners are laminated in a form of two layers or three layers, and in toner particles having a large particle size. When the shape of toner particles is that irregularity is less on the surface and the toner particles are close to a sphere, a space size, for example, between toner particles is decreased, resulting in excellent low temperature fixability.

The shape of the toner particles gives great influence to toner characteristics, and a certain aspect is present in the relationship with trade-off. In the toner according to the present embodiment, when the shape factor SF-2 showing the degree of irregularity on the surface of toner particles is satisfied with the expressions (1) and (2) to the toner particles having a large particle size of 25% particle size $D_{25V}$ or more and the toner particles having a small particle size of 75% particle size $D_{75V}$ or less in the particle size distribution of toner particles, both the cleanability and the transferability are established, and additionally, the irregularity on the surface of the toner particles having a large particle size can be reduced. Therefore, low temperature fixability is good.

Specifically describing, where (a) and (b) are not satisfied with the expression (1) and (b)/(a) is less than 0.9, the degree of irregularity on the surface of the toner particles having a large particle size is too small as compared with the degree of irregularity on the surface of the toner particles having a small particle size. As a result, disruption of balance between physical adhesion and chargeability arises, and a so-called selective development is generated such that only the toner particles having a specific particle size in a toner are selectively used in development. Where (b)/(a) exceeds 1.02, even though (a) is satisfied with the expression (2), the value of (b) is excessively large and irregularity on the surface of the toner particles having a large particle size is excessively increased. As a result, distribution of the triboelectric charge on the surface of the toner particles is heterogeneous, and a so-called scattering is generated such that the toner is adhered on an area to be a white background area of a recording medium. The toner particles having a large particle size are large as compared with the toner particles having a small particle size, and are therefore conspicuous when scattered.

When (b)/(a) is satisfied with the expression (1) as described above, the degree of irregularity on the surface of the toner particles having a large particle size can be prevented from being excessively small as compared with the degree of irregularity on the surface of the toner particles having a small particle size. As a result, balance between physical adhesion and chargeability is maintained between toner particles, and selective development can be prevented from being generated. Furthermore, the value of (b) can be prevented from being excessively large, and the irregularity on the surface of the toner particles having a large particle size can be prevented from being excessively increased. As a result, scattering in distribution of charging amount on the surface of toner particles can be suppressed, thereby suppressing generation of scattering. In the fixing process, when toner particles are laminated on the surface of a paper, a size of space between toner particles is decreased as the irregularity on the surface of toner particles is less. As a result, thermal conductivity is excellent, which is effective to low temperature fixing. In the case that comparison is made in particles having the same shape but having different particle size, a size of space between toner particles is increased in the particles having a large particle size, and as a result, the effect of low temperature fixing is remarkably developed. Therefore, when (b)/(a) is satisfied with the expression (1) to thereby prevent the value of (b) from being excessively increased, the irregularity on the surface of the toner particles having a large particle size can be prevented from being excessively increased, and a size of space between toner particles can be decreased. As a result, a toner having excellent thermal conductivity and excellent low temperature fixability can be achieved.

Toner particles decrease its cleanability as a particle size is small. However, decrease in cleanability can be prevented by increasing the irregularity on the surface of toner particles. Where (a) is not satisfied with the expression (2) and (a) is less than 140, the irregularity on the surface of the toner particles having a small particle size is excessively decreased, and as a result, sufficient cleanability is not obtained. When (a) is 140 or more, the irregularity on the surface of the toner particles having a small particle size is increased, thereby good cleanability can be obtained as the whole of toner particles. On the other hand, where (a) exceeds 150, the irregularity on the surface of the toner particles having a small particle size is excessively increased, and transfer efficiency deteriorates. When (a) is satisfied with the expression (2) as described before, the degree of the irregularity on the surface of the toner particles having a small particle size can be made appropriate, making it possible to achieve excellent cleanability and transferability.

When the average value in the entire toner particles of the irregularity shape factor SF2 is 140 or less, there is no problem on the cleanability in the case that the number of image formation is small. However, where the number of image formation is large, for example, exceeds 50,000, cleaning defect begins to be generated. When the average value in the entire toner particles of the irregularity shape factor SF-2 is larger than 140 as described above, cleaning defect due to increase of the number of image formation can be suppressed from being generated.

From the above, according to the toner according to the present embodiment, high quality images can stably be formed.

(b)/(a) is preferably from 0.96 to 1.02. When the (b)/(al is from 0.96 to 1.02, the degree of irregularity on the surface of the toner particles having a small particle size can conform to the degree of irregularity on the surface of the toner particles having a large particle size. As a result, the balance between physical adhesion between toner particles and chargeability is further surely maintained, making it possible to further surely prevent generation of selective development.

The toner according to the present embodiment is that the roundness shape factor SF1 as a shape factor showing the degree of roundness of toner particles is not less than 150 and not more than 160. The roundness shape factor SF-1 is not limited to this range, but is preferably from 150 to 160 as in the present embodiment. The toner particles are that flowability is excellent as its shape is close to a roundest sphere and physical adhesion is reduced. Therefore, transfer efficiency is improved. On the other hand, where the shape is close to a roundest sphere, the cleanability is decreased. Specifically, where the average value in the entire toner particles of the roundness shape factor SF-1 is smaller than 150, sufficient cleanability may not be obtained, and where it is larger than 160, sufficient transfer efficiency may not be obtained. When the roundness shape factor SF-1 is not less than 150 and not more than 160 as described above, good flowability and transfer efficiency can be obtained without impairing the cleanability.

The roundness shape factor SF-1 and irregularity shape factor SF-2 of toner particles, defining a shape of toner particles are values measured according to the following methods.

2.0 g of a toner, 1 ml of sodium alkyl ether sulfate and 50 ml of pure water were added to 100 ml beaker, and well stirred to prepare a toner dispersion. The toner dispersion was treated with an ultrasonic homogenizer (manufactured by Nihonseiki Kabushiki Kaisha Ltd.) at output of 50 μA for 5 minutes, and then further dispersed. The dispersion was allowed to stand for 6 hours, and a supernatant was removed. 50 ml of pure water was added to the dispersion, followed by stirring with a magnetic stirrer for 5 minutes, and suction filtration was then conducted using a membrane filter (opening: 1 μm). Washed material on the membrane filter was vacuum dried in a desiccator containing silica gel therein about overnight to obtain the objective toner.

A metal film (Au film, thickness: 0.5 μm) was formed on the surface of the toner particles having the surface thus washed, by sputter deposition. 200 to 300 metal film-coated toners were extracted at random from the metal film-coated toners with a scanning electron microscope (trade name: S-570, manufactured by Hitachi, Ltd.) at an accelerating voltage of 5 kV and at 1,000 magnifications, and photographed. The electron microscope photograph data are image analyzed with an image analysis software (trade name: A-ZO-KUN, manufactured by Asahi Kasei Engineering Corporation). Particle analysis parameters of the image analysis software (A-ZO-KUN) are small graphic removal area: 100 pixels, shrinkage separation: 1 (number of times), small graphic: 1, number of times: 10, noise removal filter: none, shading: none, and result display unit: μm. From the maximum length MXLNG, peripheral length PERI and graphic area AREA of particles obtained by the image analysis, the shape factors SF-1 and SF-2 are obtained by the following expressions (A) and (B)

$$\text{SF-1}=\{(MXLNG)2/\text{AREA}\}\times(100\pi/4) \quad (A)$$

$$\text{SF-2}=\{(PERI)2/\text{AREA}\}\times(100/4\pi) \quad (B)$$

The shape factor SF-1 s a value represented by the expression (A), and shows the degree of roundness of a shape of toner particles. When the value of SF-1 is 100, the shape of toner particles is a roundest sphere. The shape is amorphous as the value of SF-1 is increased. Furthermore, the shape factor SF-2 is a value represented by the expression (B), and shows the degree of irregularity of a surface shape of toner particles. When the value of SE-2 is 100, irregularity is not present on the surface of toner particles. The irregularity is remarkable as the value of SF-2 is increased. The irregularity shape factor SF-2 of toner particles having a particle size of 75% particle size $D_{75V}$ or less represented by (a) is sometimes called "SF-2(a)", and the irregularity shape factor SF-2 of toner particles having a particle size of 25% particle size $D_{25V}$ or more represented by (b) is sometimes called "SF-2(b)".

The irregularity shape factor SF-2(a) of toner particles having a particle size of 75% particle size $D_{75V}$ or less and the irregularity shape factor SF-2(b) of toner particles having a particle size of 25% particle size $D_{25V}$ or more are measured as follows. Particle Size distribution of a toner finally obtained is measured with a particle size measurement instrument, such as Multisizer III (trade name) manufactured by Beckman Coulter, Inc., and the values of 75% particle size $D_{75V}$ and 25% particle size $D_{25V}$ are obtained from the results. Furthermore, the irregularity shape factor of a toner is separately measured to obtain the relationship between a particle size of each particle and the irregularity shape factor, and the respective irregularity factors of the particles having a particle size of 75% particle size $D_{75V}$ or less and the particles having a particle size of 25% particle size $D_{25V}$ or more are averaged and obtained from the result.

The toner according to the present embodiment has a volume average particle size in the entire toner particles of from 4 to 8 μm. The volume average particle size in the entire toner particles is not limited to this, but the volume average particle size of from 4 to 8 μm as in the present embodiment is preferred. Where the volume average particle size in the entire toner particles is smaller than 4 μm, scattering of a toner and fogging of an image are liable to be generated, and cleaning defect may be generated. On the other hand, where the volume average particle size in the entire toner particles is larger than 8 μm, high definition images cannot be formed. When the volume average particle size in the entire toner particles is from 4 to 8 μm as described above, generation of scattering of a toner and fogging of an image can be suppressed, and generation of cleaning defect can be prevented. Additionally, high definition images can be formed.

The volume average particle size in the entire toner particles is more preferably from 5 to 7 μm. When the volume average particle size in the entire toner particles is from 5 to 7 μm, generation of scattering of a toner and fogging of image can further surely be suppressed, and furthermore, generation of cleaning defect can further surely be suppressed. Additionally, further high definition images can be formed.

The volume average particle size, 25% particle size $D_{25V}$ and 75% particle size $D_{75V}$ are measured with a particle size distribution measurement instrument "Multisizer III," manufactured by Beckman Coulter, Inc. Measurement conditions of a particle size are shown below.

Aperture diameter: 100 μm

The number of particles measured: 50,000 counts

Analysis software: Coulter Multisizer AccuComp, Version 1.19 (manufactured by Beckman Coulter, Inc.)

Electrolyte: ISOTON-II (manufactured by Beckman Coulter, Inc)

Dispersant: Sodium alkyl ether sulfate

The measurement method is as follows.

50 ml of an electrolyte, 20 mg of a sample and 1 ml of a dispersant are added to a beaker, and dispersion treated with an ultrasonic dispersing device for 3 minutes to prepare a measuring sample. A particle size is measured with the instrument "Multisizer III", and volume particle size distribution and number particle size distribution are obtained from the measurement results obtained. The volume average particle size, 25% particle size $D_{25V}$ and 75% particle size $D_{75V}$ are calculated from those particle size distributions. The volume average particle size used herein means particle size $D_{50V}$ that a cumulative volume from a large particle size side in a particle size distribution by volume (hereinafter sometimes referred to as a "cumulative volume distribution") becomes 50%.

The toner particles constituting the toner according to the present embodiment comprise a binder resin and a colorant. In the present embodiment, the toner particles further comprise a release agent. Specific examples of the binder, colorant and release agent contained in the toner particles are described hereinafter.

Specifically describing, the toner according to the present embodiment comprises a first toner particle group comprising plural toner particles and a second toner particle group comprising spheronized toner particles, having a volume average particle size larger than that of the first toner particle group.

A method for producing a toner according to the present embodiment is described below. FIG. 1 is a flow chart showing one example of the procedures of a method for producing a toner according to the present embodiment. The method for producing a toner according to the present embodiment comprises a premixing step (step S1) of mixing at least a binder resin, a colorant and a release agent to prepare a mixture, a melt-kneading step (step S2) of melt-kneading the mixture to prepare a melt-kneaded mixture, a pulverization step (step S3) of pulverizing a solidified product of the melt-kneaded mixture to prepare a first pulverized material and a second pulverized material having a volume average particle size larger than that of the first pulverized material, a first classification step (step S4) of classifying the first pulverized material obtained in the pulverization step to prepare a first toner particle group, a spheronization step (step S5-(*a*)) of spheronizing toner particles constituting the second pulverized material obtained in the pulverization step, a second classification step (step S5-(*b*)) of classifying the second pulverized material comprising the spheronized toner particles to prepare a second toner particle group having a volume average particle size larger than that of the first toner particle group, and a mixing step (step S6) of mixing the first toner particle group and the second toner particle group. The first classification step corresponds to a first group preparation step of preparing the first toner particle group (hereinafter sometimes referred to as "first toner particle group production step"), and the spheronization step and the second classification step are included in a second group preparation step of preparing the second toner particle group of the step S5 (hereinafter sometimes referred to as "second particle group production step").

Each production step of step S1 to step S6 is described in detail below. In the present embodiment, the second group preparation step of step S5 for preparing the second toner particle group is conducted after the first group preparation step of step S4 for preparing the first toner particle group, but the first group preparation step and the second group preparation step may simultaneously be conducted, and the first group preparation step may be conducted after the second group preparation step. The production of the toner according to the present embodiment is initiated by moving from step S0 to step S1.

[Premixing Step]

In the premixing step of Step S1, the toner raw material at least containing a binder resin and colorant is dry-mixed by a mixer so as to prepare the toner raw material mixture.

In addition to the binder resin and the colorant, the toner raw material may also contain other toner additives. As the other toner additives, a release agent, a charge control agent, and so forth can be used, for example.

The mixers usable for the dry-mixing operation include, for example, Henschel-type mixing apparatuses such as a Henschel mixer (trade name: FM MIXER) manufactured by Mitsui Mining Co., Ltd., SUPERMIXER (trade name) manufactured by KAWATA MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Each component of the toner raw material is described below.

(a) Binder Resin (a) Binder Resin

A selection of the binder resin is not particularly limited, and usable is a binder resin for black toner or color toner. Examples of the binder resign include: polyester-based resin; styrene-based resin such as polystyrene and styrene-acrylic ester copolymer resin; acryl-based resin such as polymethylmethacrylate; polyolefin-based resin such as polyethylene; polyurethane; and epoxy resin. It is also possible to use resin which is obtained by mixing a release agent into a raw material monomer mixture to thereby effect a polymerization reaction. The binder resins may be used each alone, or two or more of the binder resins may be used in combination. It is preferred for the binder resin to particularly contain a polyester resin among the above-described resins. The polyester resin has excellent durability and transparency as compared with other resins such as an acrylic resin, and has low softening temperature (Tm). Therefore, when the binder resin contains a polyester resin, a toner having excellent durability and color formation property, and having excellent low temperature fixability capable of fixing at lower temperature is obtained.

A glass transition temperature (Tg) of the binder resin is not particularly limited and can be appropriately selected from a broad range. However, considering fixing property and storage stability of a manufactured toner, the glass transition temperature (Tg) of the binder resin is preferably selected to be 30° C. or more and 80° C. or less. When the glass transition temperature (Tg) of the binder resin is less than 30° C., heat aggregation of toners easily occurs inside the image forming apparatus due to insufficient storage stability, which may cause poor development undesirably. Further, there is an undesirable drop in a temperature at which high-temperature offset phenomenon begins to occur (hereinafter, referred to as "high-temperature offset-starting temperature"). The high-temperature offset phenomenon refers to a phenomenon in which, when a toner is heated and pressurized by a fixing member such as a heating roller so as to be fixed onto a recording medium, the overheating of the toner causes that an aggregation force of toner particles becomes lower than an adhesive force between the toner and the fixing member, so that a toner layer is segmented and the toner is partially removed by adherence to the fixing member. On the other hand, when the glass transition temperature (Tg) of the binder resin exceeds 80° C., poor fixing may occur due to a decline in fixing property.

A softening temperature (Tm) of the binder resin is not particularly limited and may be appropriately selected from a broad range, and preferably to be 150° C. or less, and more preferably to be 60° C. or more and 150° C. or less. When the softening temperature (Tm) of the binder resin is less than 60° C., the storage stability of the toner deteriorates and the heat aggregation of toners easily occurs inside the image forming apparatus. This causes a failure to stably feed toner to an image bearer and poor development easily occurs. Further, this also may induce a breakdown of the image forming apparatus. On the other hand, when the softening temperature (Tm) of the binder resin exceeds 150° C., the binder resin less easily melts in the melt-kneading step, thus resulting in difficulty in kneading the toner raw material. This may cause the colorant, the release agent, the charge control agent, and so forth to be poorly dispersed in the kneaded material. Further, when the toner is fixed to the recording medium, the toner hardly melts or softens, thus possibly causing that the toner is poorly fixed to the recording medium and poor fixing occurs undesirably.

(b) Colorant

The colorant includes, for example, a colorant for yellow toner, a colorant for magenta toner, a colorant for cyan toner, and a colorant for black toner.

Examples of the colorant for yellow toner include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180 and C.I. Pigment Yellow 185; inorganic pigments such as yellow iron oxide and yellow ocher; nitro dyes such as C.I. Acid Yellow 1; and oil-soluble dyes such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21, which are classified by Color Index.

Examples of the colorant for magenta toner include C.I. Pigment Red 49, C.I. Pigment Red 57:1, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15, which are classified by Color Index.

Examples of the colorant for cyan toner include C.I. Pigment Blue 15, C.I. Pigment Blue 16, C.I. Solvent Blue 55, C.I. Solvent Blue 70, C.I. Direct Blue 25 and C.I. Direct Blue 86, which are classified by Color Index.

Examples of the colorant for black toner include carbon blacks such as channel black, roller black, disk black, gas furnace black, oil furnace black, thermal black and acetylene black. An appropriate carbon black is selected from those various carbon blacks depending on design characteristics of a toner to be obtained.

Apart from those pigments, also usable herein are red pigments, green pigments, and the like pigments. The colorants may be used each alone, or two or more of the colorants may be used in combination. Further, two or more colorants of the same color type may be combined, or one or more colorants of one color type may be combined with those of a different color type.

The colorant is preferably used in form of master batch. The master batch of the colorant can be manufactured, for example, by kneading a molten material of synthetic resin and colorant. The synthetic resin used is a binder resin of the same sort as the binder resin of the toner, or resin which is well-compatible with the binder resin of the toner. A use ratio of the colorant is, although not particularly limited, preferably 30 parts by weight or more and 100 parts by weight or less based on 100 parts by weight of the synthetic resin, that is 20% by weight or more and 50% by weight based on 100% by weight of the master batch. Before being used, the master batch is granulated so as to approximately have a particle size of 2 mm to 3 mm, for example.

A content of the colorant in the toner according to the present embodiment is, although not particularly limited, preferably 4 parts by weight or more and 20 parts by weight or less on the basis of 100 parts by weight of the binder resin. In the case of using the master batch, a usage of the master batch is preferably adjusted so that the content of the colorant in the toner of the invention falls in the above range. The use of the colorant in the above range allows formation of favorable images which are sufficient in image density and excellent in color development and image quality.

(c) Release Agent

The release agent is contained to enhance an anti-offset effect. Examples of the release agent include petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular polypropylene wax and derivatives thereof, and polyolefinic polymer wax and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxyloc acids and derivatives thereof; long-chain alcohols and derivatives thereof; silicone polymers; and higher fatty acids. Examples of the derivatives include oxides, block copolymers of vinylic monomer and wax, and copolymers of vinylic monomer and wax.

The amount of the release agent used is not particularly limited and can appropriately be selected from a wide range. However, the content of the release agent in the whole amount of the toner is preferably from 3 to 10% by weight, and more preferably from 4 to 8% by weight. Where the content of the release agent is less than 3% by weight, good releasability may not possibly be obtained in fixing the toner to a recording medium. On the other hand, where the content of the release agent is larger than 10% by weight, flowability of the toner may deteriorate, and good fixing strength may not possibly be obtained. Additionally, fusion between toner particles and filming of the toner to an image bearing member may be generated.

A melting point of the release agent is preferably selected to be 50° C. or more and 150° C. or less, more preferably to be 120° C. or less. When the melting point of the release agent is less than 50° C., the release agent melts and toner particles aggregate in the developing device, which may induce, for example, poor filming of the surface of the photoreceptor. On the other hand, when the melting point of the release agent exceeds 150° C., the release agent fails to fully elute off in fixing the toner to the recording medium, which may result in a failure to sufficiently enhance an anti-high-temperature offset property. Herein, the melting point of the release agent refers to a temperature of a melting endothermic peak in a differential scanning calorimetric (abbreviated as DSC) curve obtained by DSC measurement.

(c) Charge Control Agent

The toner raw material may contain other toner addition ingredients such as a charge control agent, in addition to the binder resin, the colorant and the release agent. When the charge control agent is contained, it is possible to cause a frictional charge amount of the toner to fall in a favorable range. As the charge control agent, usable is a charge control agent for positive charge control, or a charge control agent for negative charge control. Examples of the charge control agent for positive charge control include a basic dye, quaternary ammonium salt, quaternary phosphonium salt, aminopyrine, a pyrimidine compound, a polynuclear polyamino compound, aminosilane, a nigrosine dye and its derivatives, a triphenylmethane derivative, guanidine salt, and amidine salt. Examples of the charge control agent for negative charge control include oil-soluble dyes such as oil black and spiron black; a metal-containing azo compound; an azo complex dye; metal salt naphthenate; salicylic acid; metal complex and metal salt (the metal includes chrome, zinc, and zirconium) of a salicylic acid derivative; a boron compound; a fatty acid soap; long-chain alkylcarboxylic acid salt; and a resin acid soap. The charge control agents just cited may be used each alone, and two or more of the charge control agents may be used in combination.

[Melt-Kneading Step]

In the melt-kneading step of step S2, the mixture prepared in the premixing step of step S1 is melt-kneaded to prepare a melt-kneaded mixture. The melt-kneading is conducted by heating the mixture to the temperature of the softening point or higher of the binder resin and lower than the thermal decomposition temperature thereof. The melt-kneading can melt the binder resin and disperse the toner raw materials such as the colorant, the release agent and the charge control agent other than the binder resin in the molten binder resin. The specific heating temperature at the time of melt-kneading is preferably from 80 to 200° C., and more preferably from 100 to 150° C.

For melt-kneading, it is possible to use kneading machines such as a kneader, a twin-screw extrudes, a two roll mill, a three roll mill, and laboplast mill. Examples of such kneading machines include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. The melt-kneading may be conducted by using a plurality of the kneading machines.

[Pulverization Step]

In the pulverization step of step S3, the melt-kneaded mixture prepared in the melt-kneading step of step S2 is pulverized to prepare a first pulverized material and a second pulverized material. The melt-kneaded mixture was solidified by, for example, cooling, and then pulverized into a crude pulverized material having a volume average particle size of from about 100 μm to about 5 mm by a hammer mill or a cutter mill. The crude pulverized material is then pulverized into a first pulverized material and a second pulverized material, each having the desired average particle size. The pulverization of the crude pulverized material can use, for example, a jet-type pulverizer which pulverizes utilizing supersonic jet stream, and an impact type pulverizer which introduces the crude pulverized material into a space formed between a rotator (rotor) rotating at high speed and a stator (liner) and pulverizes the crude pulverized material therein.

[First Classification Step and Second Classification Step]

In the first classification step of step S4, the first pulverized material produced in the pulverization step of step S3 is classified to prepare a first toner particle group. The second classification step of step S5-(*b*) is conducted in the same manner as in the first classification step. In the second pulverization step, a material obtained by spheronizing the second pulverized material produced in the pulverization step of step S3 in the spheronization step of step S5-(*a*) described hereinafter is classified to prepare a second toner particle group having a volume average particle size larger than that of the first toner particle group.

The first classification step is preferably conducted such that the volume average particle size of the first toner particle group obtained after classification is from 5.5 to 6.5 μm by appropriately adjusting the classification conditions. Where the volume average particle size of the first toner particle group is less than 5.5 μm, the content of small particle size particles in the toner is too small, and the cleanability may possibly be decreased. On the other hand, the volume average particle size exceeds 6.5 μm, high definition images may possibly be not obtained. Furthermore, specific surface area of the toner particles is decreased and the charge amount of the toner is reduced. As a result, the toner is not stably supplied to a latent image bearing member, and contamination in an apparatus due to toner scattering may possibly be generated.

The second classification step is preferably conducted such that the volume average particle size of the second toner particle group obtained after classification is from 7.0 to 8.0 μm. Where the volume average particle size of the second toner particle group is less than 7.0 μm, the content of small particle size particles in the toner is too large, and the cleanability may possibly be decreased. On the other hand, the volume average particle size exceeds 8.0 μm, high definition images may not possibly be obtained. Furthermore, specific surface area of the toner particles is decreased, and the charge amount of the toner is decreased. As a result, the toner is not stably supplied to a latent image bearing member, and contamination in an apparatus due to toner scattering may possibly be generated.

When the volume average particle size of the first and second toner particle groups is satisfied with the above range, the volume average particle size of the toner obtained after the mixing step is fallen within a range of from 4 to 8 μm, and a toner capable of forming high quality images can be produced. Where the volume average particle size is less than 4 μm, the content of small particle size particles in the toner is too large, and the cleanability may possibly be decreased. On the other hand, the volume average particle size exceeds 8 μm, high definition images may not possibly be obtained.

The classification condition to be adjusted is, for example, rotation speed of a classification rotor in a circling air classifier (rotary air classifier).

[Spheronization Step]

The spheronization step of step S5-(*a*) conducts spheronization treatment of the second pulverized material. The spheronization treatment can be conducted by the conventional methods, and examples thereof include a method of spheronizing the second pulverized material by hot air and a method of spheronizing the second pulverized material by mechanical impact force. The spheronization method is preferably a method by mechanical impact force, capable of spheronizing the second pulverized material while appropriately giving irregularity. In the spheronization treatment by heat, toner particles fuse with each other, and the release agent contained in the toner bleeds on the surface of the toner. As a result, flowability of the toner may possibly deteriorate.

The toner particles constituting the second pulverized material can be spheronized while appropriately giving irregularity to the surface thereof by spheronizing the same by mechanical impact force. As a result, the toner according to the present embodiment can further easily be obtained. Where the toner raw material contains the release agent, when conducting spheronization by applying heat, decrease in flowability of a toner, fusion between toner particles and filming of a toner to an image bearing member or the like may possibly be generated by bleeding of the release agent. When spheronization is conducted by applying mechanical impact force as described above, the release agent can be prevented from bleeding. As a result, decrease in flowability of a toner, fusion between toner particles and generation of filming of a toner to an image bearing member or the like can be prevented.

Figure 2:
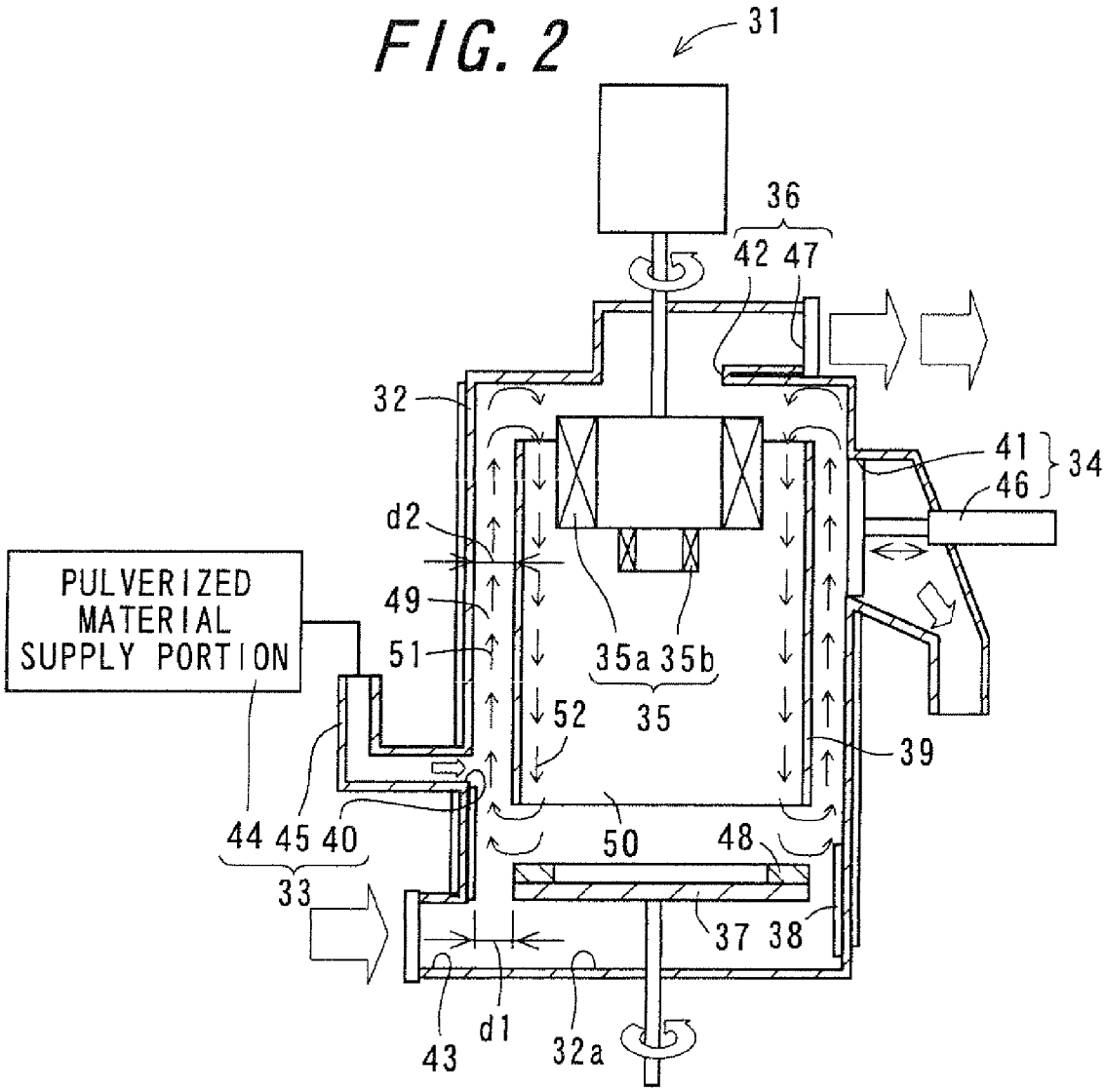
FIG. 2 is a sectional view schematically showing a configuration of an impact-type spheronizing device.
Figure 3:
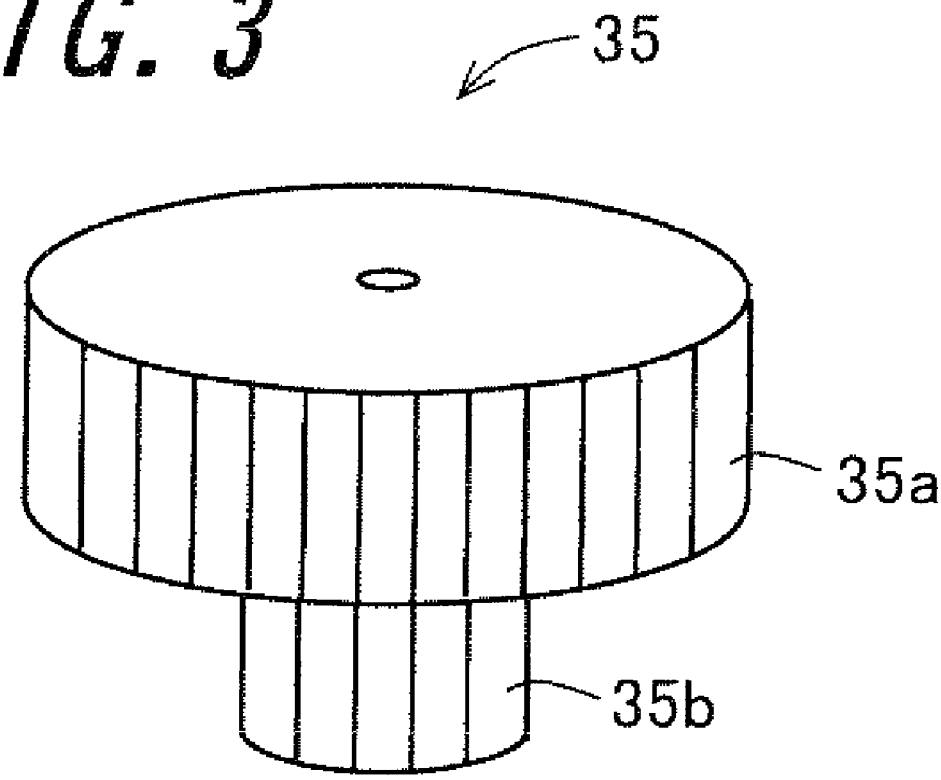
FIG. 3 is a perspective view showing a configuration of a classifying rotor disposed in the impact-type spheronizing device.

A method for spheronizing a pulverized material by mechanical impact force is described below. FIG. 2 is a sectional view schematically showing a configuration of an impact-type spheronizing device 31. FIG. 3 is a perspective view showing a configuration of a classifying rotor 35 disposed in the impact-type spheronizing device 31. The impact-type spheronizing device 31 uses the mechanical impact force to form the pulverized material of the resin composition into the spherical shape. The impact-type spheronizing device 31 includes a treatment tank 32, a pulverized material input portion 33, a toner particle discharge portion 34, a classifying rotor 35, a fine particle discharge portion 36, a dispersing rotor 37, a liner 38, and a partition member 39.

The treatment tank 32 is a substantially cylindrical container for treatment. Inside the treatment tank 32, the classifying rotor 35 is disposed in an upper part, and on side walls of the treatment tank 32 are formed a pulverized material inlet 40 of the pulverized material input portion 33 and a toner particle outlet 41 of the toner particle discharge portion 34. Further, a fine particle outlet 42 of the fine particle discharge portion 36 is formed on the side wall at an upper position from the classifying rotor 35 of the treatment tank 32. At a bottom part inside the treatment tank 32 are disposed the dispersing rotor 37 and the liner 38. Further, in the present embodiment, at a bottom surface portion 32*a* of the treatment tank 32 is formed a cooled air inlet 43 for letting the cooled air flow into the treatment tank 32. An internal diameter of the treatment tank 32 according to the embodiment is 20 cm.

The pulverized material input portion 33 includes a pulverized material supply portion 44, a pipeline 45, and a pulverized material inlet 40. The pulverized material supply portion 44 includes a storage container (not shown), a vibration feeder (not shown), and a compressed air intake nozzle (not shown). The storage container is a container-like member having an internal space where the pulverized material of resin composition is temporarily stored. Further, one end of the pipeline 45 is connected to one side surface or a bottom surface of the storage container, which communicates an internal space of the storage container and an internal space of the pipeline 45 with each other. The vibration feeder is disposed so that the storage container vibrates by vibration of the vibration feeder. The vibration feeder supplies the pulverized material of resin composition in the storage container into the pipeline 45. The compressed air intake nozzle is disposed so as to be connected to the pipeline 45 in the vicinity of a connection portion between the storage container and the pipeline 45. The compressed air intake nozzle supplies the compressed air into the pipeline 45 and accelerates the flow of the pulverized material of resin composition inside the pipeline 45 toward the pulverized material inlet 40. The pipeline 45 is a pipe-like member which has one end connected to the storage container and the other end connected to the pulverized material inlet 40. Through the pipeline 45, an admixture of the pulverized material of resin composition supplied from the storage container and the compressed air supplied from the compressed air intake nozzle is blown off from the pulverized material inlet 40 toward the inside of the treatment tank 32.

In the pulverized material supply portion 44 as stated above, the compressed air is firstly introduced from the compressed air intake nozzle into the pipeline 45 and at the same time, the pulverized material stored in the container of the supply portion is made to vibrate by the vibration feeder and thereby supplied from the storage container to the pipeline. The pulverized material supplied to the pipeline is delivered by pressure with the aid of the compressed air introduced from the compressed air intake nozzle, and then introduced into the treatment tank 32 from the pulverized material inlet 40 connected to a downstream side in an air intake direction of the pipeline 45.

The toner particle discharge portion 34 includes a toner particle discharge valve 46 and a toner particle outlet 41. The toner particle discharge portion 34 discharges to the outside of the treatment tank 32 the toner particles which are the pulverized material formed into the spherical shape inside the treatment tank 32. The toner particle discharge valve 46 is opened after a lapse of a predetermined treatment time. The opening of the toner particle discharge valve 46 causes the toner particles which are the pulverized material formed into the spherical shape inside the treatment tank 32, to be discharged from the toner particle outlet 41.

The classifying rotor 35 is a rotor for discharging fine particles each having a diameter less than 2 μm, for example, contained in the pulverized material which has been fed from the pulverized material input portion 33. The classifying rotor 35 classifies the pulverized materials in accordance with a particle diameter by utilizing the difference in centrifugal force giver to the pulverized material depending on the weight of the pulverized material.

In the present embodiment, the classifying rotor 35 includes a first classifying rotor 35*b* and a second classifying rotor 35*a*. The first classifying rotor 35*b* is disposed below the second classifying rotor 35*a* and rotates in the same direction as that of the second classifying rotor 35*a*. Such an arrangement that the first classifying rotor 35*b* is disposed below the second classifying rotor 35*a* allows the pulverized material to be effectively dispersed even when the pulverized material has been aggregated, thus ensuring the removal of fine particles.

Above the classifying rotor 35 inside the treatment tank 32 is formed the fine particle outlet 42 through which the fine particles classified by the classifying rotor 35 are discharged. The fine particle discharge portion 36 includes the fine particle outlet 42 and a fine particle discharge valve 47 which is open during the spheronization treatment of the pulverized material.

In a lower part inside the treatment tank 32 are disposed a dispersing rotor 37 and a liner 38. The dispersing rotor 37 is composed of a circular plate member and a support shaft. The circular plate member is supported by the support shaft so that a circular surface of the circular plate member is parallel to a bottom surface of the treatment tank 32. An outer circumferential part in an upper surface in a vertical direction of the circular plate member is provided with a blade 48. The support shaft has one end connected to a lower surface in a vertical direction of the circular plate member and the other end connected to a driving mechanism (not shown). The support shaft supports the circular plate member and transfers to the circular plate member the rotary drive which is caused by the driving mechanism, in the same direction as that of the classifying rotor 35. This rotates the dispersing rotor 37 in the same direction as that of the classifying rotor 35. The liner 38 is a plate member which is provided at a position of an inner wall surface of the treatment tank 32, opposed to side surfaces of the circular plate member of the dispersing rotor 37 and the blade 48, so as to be fixed on the inner wall surface in contact therewith. In a surface of the liner 38 opposed to the side surfaces in the vertical direction of the circular plate member of the dispersing rotor 37 and the blade 48 is/are formed one groove or a plurality of grooves extending in substantially parallel with the vertical direction.

A clearance d1 between the dispersing rotor 37 and the liner 38 is in a range of from 1.0 mm to 3.0 mm. The clearance d1 in such a range allows an easy manufacture of the toner having the shape as above without increasing the burden on the device. When the clearance d1 between the dispersing rotor 37 and the liner 38 is less than 1.0 mm, the pulverized material will be further pulverized during the spheronization treatment, which may cause the pulverized material to be softened by heat. The pulverized material thus softened will cause the toner particles to be denatured and moreover, be attached to the dispersing rotor 37, the liner 38, and the other part, which increases the load on the device. This will result in a decrease in productivity of the toner. When the clearance d1 between the dispersing rotor 37 and the liner 38 exceeds 3.0 mm, a rotary speed of the dispersing rotor 37 needs to be higher in order to obtain toner particles having a high degree of circularity, which also causes the pulverized material to be further pulverized. Excessive pulverization of the pulverized material will cause the pulverized material to be softened, thus ending up with the same problem as mentioned above.

Above the dispersing rotor 37 inside the treatment tank 32 is disposed the partition member 39. The partition member 39 is a substantially cylindrical member for segmenting the inside of the treatment tank 32 into a first space 49 and a second space 50. A size of the partition member 39 is, when viewed in a radial direction thereof, smaller than a size of the dispersing rotor 37 and larger than a size of she classifying rotor 35. The first space 49 is a space located on a side of the inner wall surface inside the treatment tank 32 when viewed in a radial direction of the treatment tank 32. The second space 50 is a space located on an opposite side of the inner wall surface inside the treatment tank 32 when viewed in the radial direction of the treatment tank 32. The first space 49 is a space for leading to the classifying rotor 35 the pulverized material taken in and the pulverized material formed into the spherical shape. The second space 50 is a space for forming the pulverized material into the spherical shape with the aid of the dispersing rotor 37 and the liner 38.

A clearance d2 between one end of partition member 39 (hereinafter referred to as "an end of the partition member 39") located on the side of the inner wall surface of the treatment tank 32 when viewed in the radial direction thereof, and the inner wall surface of the treatment tank 32 is preferably in a range of from 20.0 mm to 60.0 mm. When the clearance d2 between the end of the partition member 39 and the inner wall surface of the treatment tank 32 falls in such a range, the spheronization treatment can be efficiently carried out in a short time without increasing the burden on the device. When the clearance d2 between the end of the partition member 39 and the inner wall surface of the treatment tank 32 is less than 20.0 mm, an area of the second space 50 is too large and a residence time of the pulverized material circling in the second space 50 is short, which may result in insufficient spheronization of the pulverized material. This may cause a decrease in the productivity of the toner. When the clearance d2 between the end of the partition member 39 and the inner wall surface of the treatment tank 32 exceeds 60.0 mm, the residence time of the pulverized material around the dispersing rotor 37 is long and the pulverized material is further pulverized during the spheronization treatment, which may cause the surface of the pulverized material to be molten. This may lead to alteration of the surface of pulverized material and fusion of the pulverize material inside the device.

In the present embodiment, the bottom part of the treatment tank 32 below the dispersing rotor 37 when viewed in the vertical direction is provided with the cooled air inlet 43 for letting the cooled air flow into the treatment tank 32. The cooled air inlet 43 is used to let the air cooled down in a cooling process flow into the treatment tank 32. The cooled air inlet 43 is connected to the cooled air supply portion 26 so that the cooled air generated in the device is led into the treatment tank 32.

A temperature inside the treatment tank 32 rises up by collision of the pulverized material against the blade 48, the liner 38, the inner wall surface of the treatment tank 32, the partition member 39, etc. The cooled air inlet 43 helps the temperature inside the treatment tank 32 decrease by introducing the cooled air into the treatment tank 32. The temperature and inflow volume of the cooled air are not particularly limited and determined in accordance with the rotary speed of the dispersing rotor 37, the size of the treatment tank 32, and the like element so that the temperature inside the treatment tank 32 is equal to or less than the glass transition temperature of the binder resin contained in the resin composition, for example, from 20° C. to 40° C. A thermometer may be disposed inside the treatment tank 32 to measure the temperature inside the treatment tank 32. Alternatively, a temperature of the air discharged from the fine particle outlet 42 together with the fine particles may be measured to determine the temperature inside the treatment tank 32 since the temperature of the air substantially corresponds to the temperature inside the treatment tank 32. In the embodiment, the cooled air of from 0° C. to 20° C. is taken into the treatment tank 32. In this case, the temperature of the air discharged from the fine particle outlet 42 together with the fine particles is around 50° C.

The impact-type spheronizing device 31 having the configuration as described above forms the pulverized material of resin composition into the spherical shape as follows. First of all, the classifying rotor 35 and the dispersing rotor 37 are driven to rotate, and in a state where the fine particle discharge valve 47 is open, a predetermined amount of the pulverized material is put in the treatment tank 32 by the pulverized material input portion 33. The pulverized material is put in the first space 49 inside the treatment tank 32. An amount of the pulverized material fed by the pulverized material input portion 33 is determined in accordance with the processing ability of the device. The processing ability of the device is determined by the size of the treatment tank 32, the rotary speed of the dispersing rotor 37, and the like element. The pulverized material fed by the pulverized material input portion 33 circles in the first space 49 by the rotation of the classifying rotor 35 and the dispersing rotor 37 and is directed to an upper part of the treatment tank 32 as illustrated by an arrow 51 until the pulverized material reaches the classifying rotor 35.

The pulverized material risen up to the classifying rotor 35 circles by the rotation of the classifying rotor 35, and the centrifugal force is thus applied to the pulverized material. The pulverized material having a small weight passes through the classifying rotor 35 and then discharged from the fine particle discharge outlet 42 since the centrifugal force acted on the pulverized material having a small weight is smaller than the centrifugal force acted on the pulverized material having a large weight. The pulverized material which has not discharged from the fine particle outlet 42, circles in the second space 50 and is thus directed downward in an arrow 52 direction. When the pulverized material reaches the dispersing rotor 37, the pulverized material is formed into the spherical shape by collision against the blade 48 of the dispersing rotor 37, collision against the liner 38, and the like action, thereafter moving back to the first space 49.

The pulverized material moved to the first space 49 rises again up to the classifying rotor 35, and the pulverized material having a small weight is discharged from the fine particle outlet 42. The pulverized material which is not discharged from the fine particle outlet 42, circles again in the second space 50 and is directed downward to the dispersing rotor 37 to be thereby formed into the spherical shape.

The treatment just described is repeated, and after a lapse of a predetermined time, the toner particle discharge valve 46 of the toner particle discharge portion 34 is opened. When the toner particle discharge valve 46 is opened, the pulverized material present in the first space 49 is discharged from the toner particle outlet 41. The pulverized material thus discharged from the toner particle outlet 41 is formed of particles which have been treated with the spheronization treatment. Such particles will become toner particles. As described above, the pulverized material can be formed into the spherical shape.

A length of time for the spheronization treatment is not particularly limited, and preferably from 5 to 240 seconds and more preferably from 30 to 240 seconds. When the length of time for the spheronization treatment is from 5 to 240 seconds, it is easy to obtain the toner of the invention as described above. When the length of time for the spheronization treatment is from 30 to 240 seconds, the entire pulverized material can be uniformly formed into the spherical shape and moreover, the fine particles can be reliably removed. It is therefore more preferable to set the time for the spheronization treatment in such a range.

When the length of time for the spheronization treatment is less than 5 seconds, the envelope degree of the pulverized material cannot be small, which may result in a failure to obtain the toner of the invention having the shape as described above. When the length of time for the spheronization treatment exceeds 240 seconds, the length of time for the spheronization treatment is too long, and the surfaces of the toner particles are easily denatured by heat generated by the spheronization treatment, which may cause the pulverized material to be fused inside the device. This leads to a decrease in the productivity of the toner particles.

In the impact-type spheronizing device 31 as described above, the fine particles are removed by the classifying rotor 35 and there is therefore no need to provide a separate classifying step. From such a viewpoint, the impact-type spheronizing device 31 is preferred.

For the impact-type spheronizing device 31 as described above, commercially-available devices are also usable including, for example, Faculty (trade name) manufactured by Hosokawa Micron Corporation.

Figure 4:
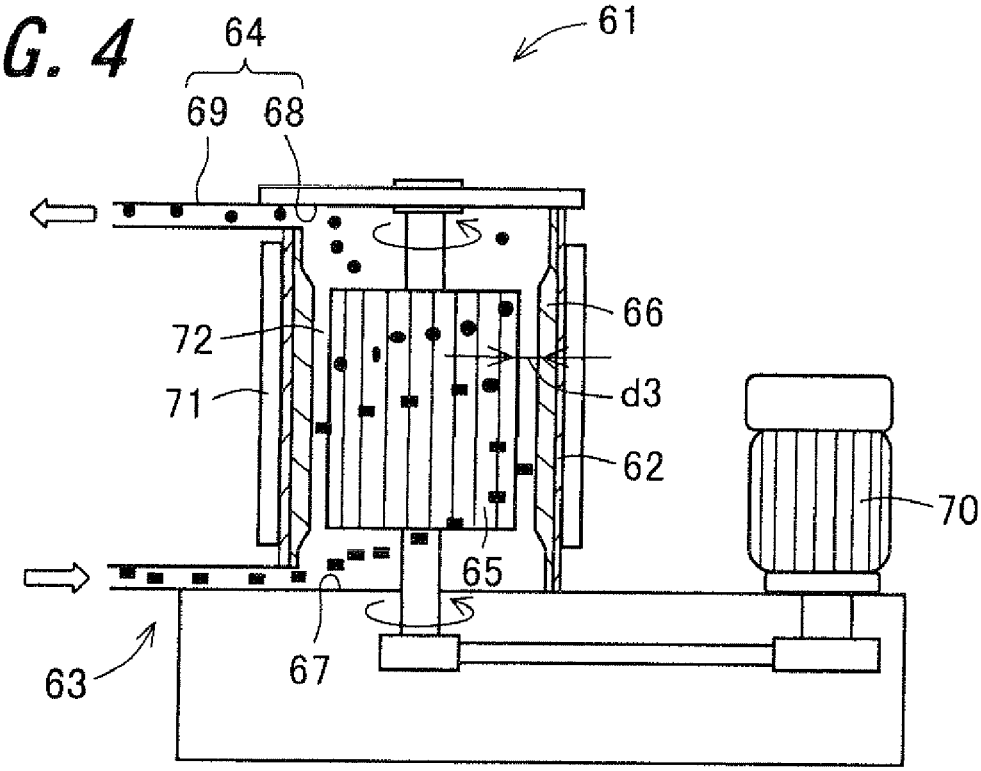
FIG. 4 is a sectional view schematically showing a configuration of an impact-type spheronizing device according to another embodiment.

FIG. 4 is a sectional view schematically showing a configuration of an impact-type spheronizing device 61 according to another embodiment. The impact-type spheronizing device 61 uses the mechanical impact force to form the pulverized material of the resin composition into the spherical shape. The impact-type spheronizing device 61 includes a treatment tank 62, a pulverized material input portion 63, a toner particle discharge portion 64, a dispersing rotor 65, and a stator 66.

The treatment tank 62 is a substantially cylindrical container for treatment. Inside the treatment tank 62, the dispersing rotor 65 and the stator 66 are provided. In a lower part of the treatment tank 62 is formed a pulverized material inlet 67 of the pulverized material input portion 63. Further, in an upper part of the treatment tank 62 is formed a toner particle outlet 68 of the toner particle discharge portion 64. An inner diameter of the treatment tank 62 according to the present embodiment is 20 cm.

The pulverized material input portion 63 has the same configuration as that of the pulverized material input portion 33 provided in the above-described impact-type spheronizing device 31, and a description of the pulverized material input portion 63 will be therefore omitted. The toner particle discharge portion 64 includes the tone particle outlet 68 and a toner particle discharge pipe 69. The toner particle discharge portion 64 discharges the toner particles which are the pulverized material formed into the spherical shape inside the treatment tank 62, to the outside of the treatment tank 62 via the tone particle outlet 68 and the toner particle discharge pipe 69.

Inside the treatment tank 62 are provided the dispersing rotor 65 and the stator 66. The dispersing rotor 65 is configured so as to be rotatable by a motor 70. The dispersing rotor 65 rotates around an axial line which corresponds to an axial line of the treatment tank 62, inside the treatment tank 62. The stator 66 is disposed in contact with an inner wall surface of the treatment tank 62.

A clearance d3 between the dispersing rotor 65 and the stator 66 is from 1.0 mm to 6.0 mm. When the clearance d3 between the dispersing rotor 65 and the stator 66 falls in such a range, the toner having the shape as above can be easily manufactured without increasing the burden on the device. When the clearance d3 between the dispersing rotor 65 and stator 66 is less than 1.0 mm, the pulverized material will be further pulverized during the spheronization treatment, which may cause the pulverized material to be softened by heat. The pulverized material thus softened will cause the toner particles to be denatured and moreover, be attached to the dispersing rotor 65, the stator 66, and the other part, which increases the load on the device. This will result in a decrease in productivity of the toner. When the clearance d3 between the dispersing rotor 65 and the stator 66 exceeds 6.0 mm, it is difficult to generate high-speed airflow inside the treatment tank 62, and the pulverized material of resin composition cannot be formed into the spherical shape sufficiently.

It is preferred that the clearance d3 between the dispersing rotor 65 and the stator 66 be set at from 3.0 mm to 5.0 mm. By setting the clearance d3 in such a range, it becomes easier to obtain the toner particles of which toner envelope degree falls in a range of from 2.0 to 3.0.

Further, an outer wall surface of the treatment tank 62 is provided with a cooling jacket 71. A temperature inside the treatment tank 62 rises up by collision of the pulverized material against the dispersing rotor 65, the stator 66, etc. The cooling jacket 71 cools the outer wall surface of the treatment tank 62 and thereby decreases the temperature inside the treatment tank 62. The cooling jacket 71 cools the outer wall surface of the treatment tank 62 so that the temperature inside the treatment tank 62 is equal to or less than the glass transition temperature of the binder resin contained in the resin composition, for example, from 20° C. to 40° C.

The impact-type spheronizing device 61 having the configuration as described above forms the pulverized material of resin composition into the spherical shape as follows. First of all, in a state where the dispersing rotor 65 is rotatable by the motor 70, the pulverized material is fed from the pulverized material input portion 63 into the treatment tank 62. The pulverized material is put in a treatment space 72 between the dispersing rotor 65 and the stator 66 inside the treatment tank 62. An amount of the pulverized material fed by the pulverized material input portion 63 is determined in accordance with the processing ability of the device. The processing ability of the device is determined by the size of the treatment tank 62, the rotary speed of the dispersing rotor 65, and the like element. The pulverized material fed by the pulverized material input portion 63 circles in the treatment space 72 by the rotation of the dispersing rotor 65 as the pulverized material collides with the dispersing rotor 65, the stator 66, and the other particles of pulverized material, and is thus directed to an upper part of the treatment tank 62. Such collisions against the dispersing rotor 65, the stator 66, and the other particles of pulverized material contribute to the spheronization of the pulverized material. The pulverized material risen up to the upper part of the treatment tank 62 is discharged from the toner particle discharge portion 64. As described above, the pulverized material can be formed into the spherical shape.

The impact-type spheronizing device 61 as described above has no classifying rotor. Accordingly, it is preferred that classification be carried out in order to remove the fine particles from the toner particles. The classification may be carried out before or after the spheronization treatment conducted by the impact-type spheronizing device 61.

For the impact-type spheronizing device 61 as described above, commercially-available devices are also usable including, for example, KRYPTRON (trade name) manufactured by Earth Technica Co., Ltd.

[Mixing Step]

In the mixing step of step S6, the first toner particle group and the second toner particle group, prepared by the first classification step of step S4 and the second classification step of step S5-(*b*) are mixed to produce the toner of the present embodiment.

In the mixing step, the second toner particles are preferably mixed in the proportion of from 5 to 40 parts by weight per 100 parts by weight of the first toner particles. By this, high definition images are formed by toner particles having a small particle size, image degradation by scattering is less, good low temperature fixability is exhibited, and excellent flowability is shown. Where the content of the second toner particles is less than 5 parts by weight, the content of large size toner particles having large irregularity is deficient. As a result, image degradation by scattering cannot be suppressed, and sufficient low temperature fixability is not obtained. Furthermore, where the content of the second toner particles exceeds 40 parts by weight, the content of large size toner particles having large irregularity is too large, and it is difficult to form high definition images.

A mixing machine used in the mixing step includes Henschel type mixing apparatuses such as a Henschel mixer (trade name, FM mixer, manufactured by Mitsui Mining Co., Ltd.), SUPERMIXER (trade name, manufactured by KAWATA MFG., Co., Ltd.) or MECHANOMILL (trade name, manufactured by Okada Seiko Co., Ltd.); ANGMILL (trade name, manufactured by Hosokawa Micron Corporation); HYBRIDIZATION SYSTEM (trade name, manufactured by Nara Machinery Co., Ltd.); and COSMOSYSTEM (trade name, manufactured by Kawasaki Heavy Industries, Ltd.).

After completion of the mixing step, the mixture moves from step S6 to step S7, thereby production of the toner of the present embodiment is completed. When the production method of a toner is used, the toner of the present embodiment having particles of large particle size side and small particle size side controlled into an appropriate shape can be produced.

With the toner particles manufactured as described above, an external additive may be mixed which bears the functions of, for example, enhancement in particle flowability, enhancement in a frictional charging property, heat resistance, improvement in long-term conservation, improvement in a cleaning property, and a control on wear characteristics of photoreceptor surfaces. Examples of the external additive include fine particles of silica, fine particles of titanium oxide, and fine particles of alumina. The external additives can be used each alone, or two or more thereof may be used in combination. The amount of the external additive added is preferably 0.1 to 10 parts by weight based on 100 parts by weight of the toner particles, considering charge amount necessary to a toner, influence to friction of a photoreceptor by the addition of an external additive and environmental characteristics of a toner. The external additive may be added to the respective particle groups before mixing the first toner particle group and the second toner particle group.

The toner having the external additive externally added to the toner particles according to need can directly be used as a one-component developer. Furthermore, the toner can be mixed with a carrier to use the resulting mixture as a two-component developer. As described before, the toner of the present embodiment is that the individual toner particles are appropriately charged. As a result, fogging on white background area of a recording medium can be prevented from being generated, and additionally, selective development and scattering can be prevented from being generated. Furthermore, the toner of the present embodiment has excellent cleanability and transferability. Therefore, use of the developer of the present embodiment containing the toner of the present embodiment can form high quality images.

As the carrier, magnetic particles can be used. Specific examples of the magnetic particles include metals such as iron, ferrite, and magnetite; and alloys of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin with which the magnetic particles is coated is not particularly limited and includes, for example, olefin-based resin, styrene-based resin, styreneacrylic resin, silicone-based resin, ester-based resin, and fluorine-containing polymer-based resin, for example. The resin used for the dispersed-in-resin carrier is also not particularly limited and includes styrene acrylic resin, polyester resin, fluorine-based resin, and phenol resin, for example.

A shape of the carrier is preferably to be spherical or flat. A volume average particle size of the carrier is, although not particularly limited, preferably 10 μm or more and 100 μm or less, and more preferably 20 to 50 μm, in consideration of formation of higher-quality images. Furthermore, a resistivity of the carrier is preferably $10^8$ Ω·cm or more, and more preferably $10^{12}$ Ω·cm or more. The resistivity of the carrier is determined in a manner that the carrier is put in a container having a sectional area of 0.50 $cm^2$ followed by tapping, and a load of 1 $kg/cm^2$ is then applied to the particles put in the container, thereafter reading a current value upon application of voltage which generates an electric field of 1,000 V/cm between the load and a bottom electrode. When the resistivity is low, application of bias voltage to a developing sleeve will cause charges to be injected to the carrier, which makes the carrier particles be easily attached to the photoreceptor. Further, in this case, breakdown of the bias voltage occurs more easily.

A magnetization intensity (maximum magnetization) of the carrier is preferably from 10 emu/g to 60 emu/g, and more preferably from 15 emu/g to 40 emu/g. The magnetization intensity depends on magnetic flux density of a developing roller. Under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a non-contact state with an image bearing member in a non-contact phenomenon where brush of the carrier is too high. Further, in a contact phenomenon, sweeping patterns may appear more frequently in a toner image.

A use ratio between the toner and the carrier contained in the two-component developer may be appropriately selected according to types of the toner and carrier without particular limitation. To take the case of the resin-coated carrier (density: 5 to 8 $g/cm^2$) as an example, it is only required that the use amount of the toner contained in the developer is 2% by weight or more and 30% by weight or less and preferably 2% by weight or more and 20% by weight or less based on a total amount of the developer. In the two-component developer, a coverage of the toner over the carrier is preferably 40% or higher and 80% or lower.

The two-component developer of the present embodiment contains the toner and carrier of the present embodiment. Therefore, the individual toner particles are appropriately charged, fogging on a non-image area, that is, fogging on a white background area of a recording medium, is not generated, and selective development and scattering can be prevented from being generated. Therefore, high quality images can be formed.

[Image Forming Apparatus]

Figure 5:
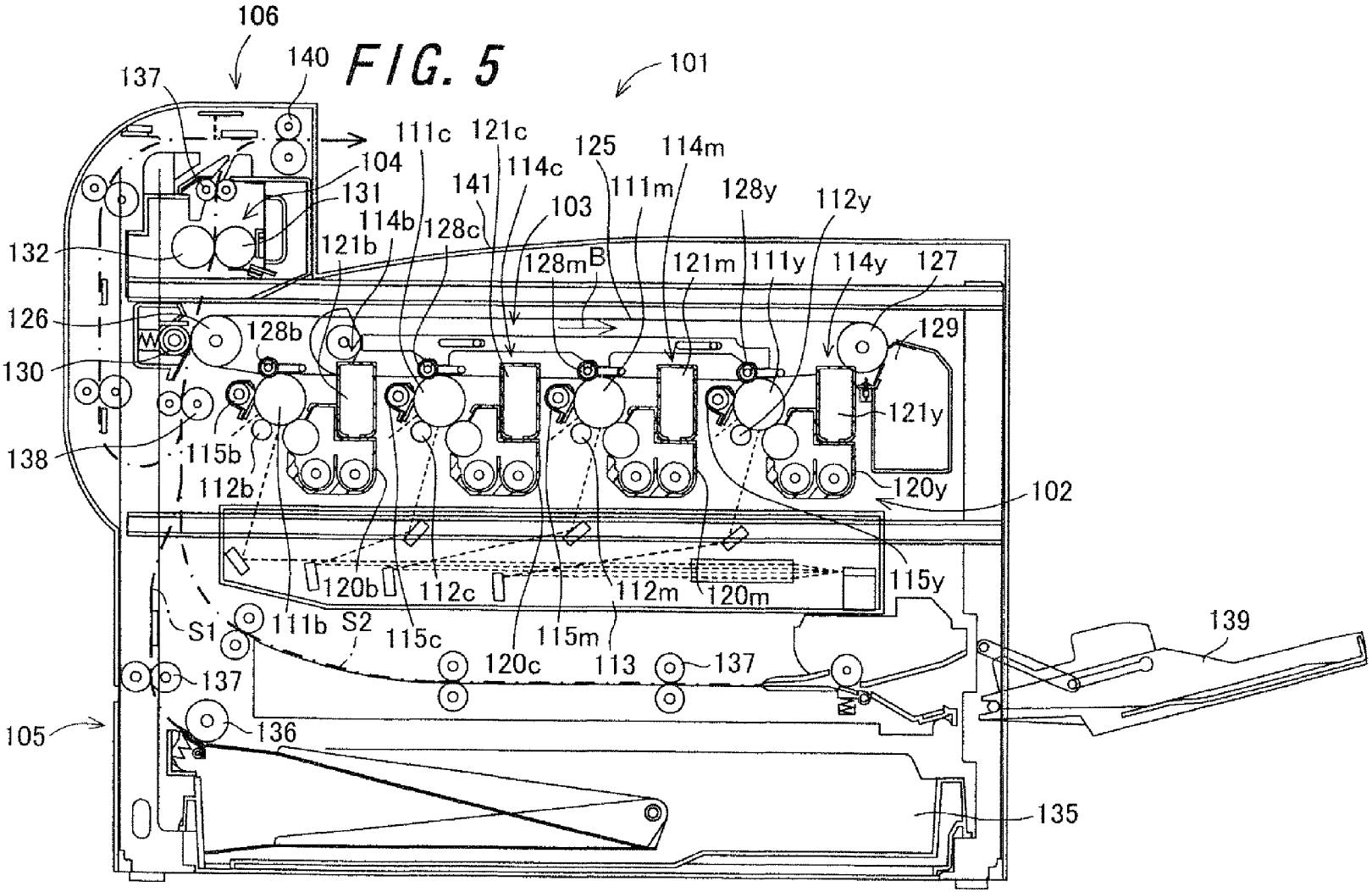
FIG. 5 is a schematic constitution view showing constitution of an image forming apparatus provided with a developing device, as one embodiment of the invention.
Figure 6:
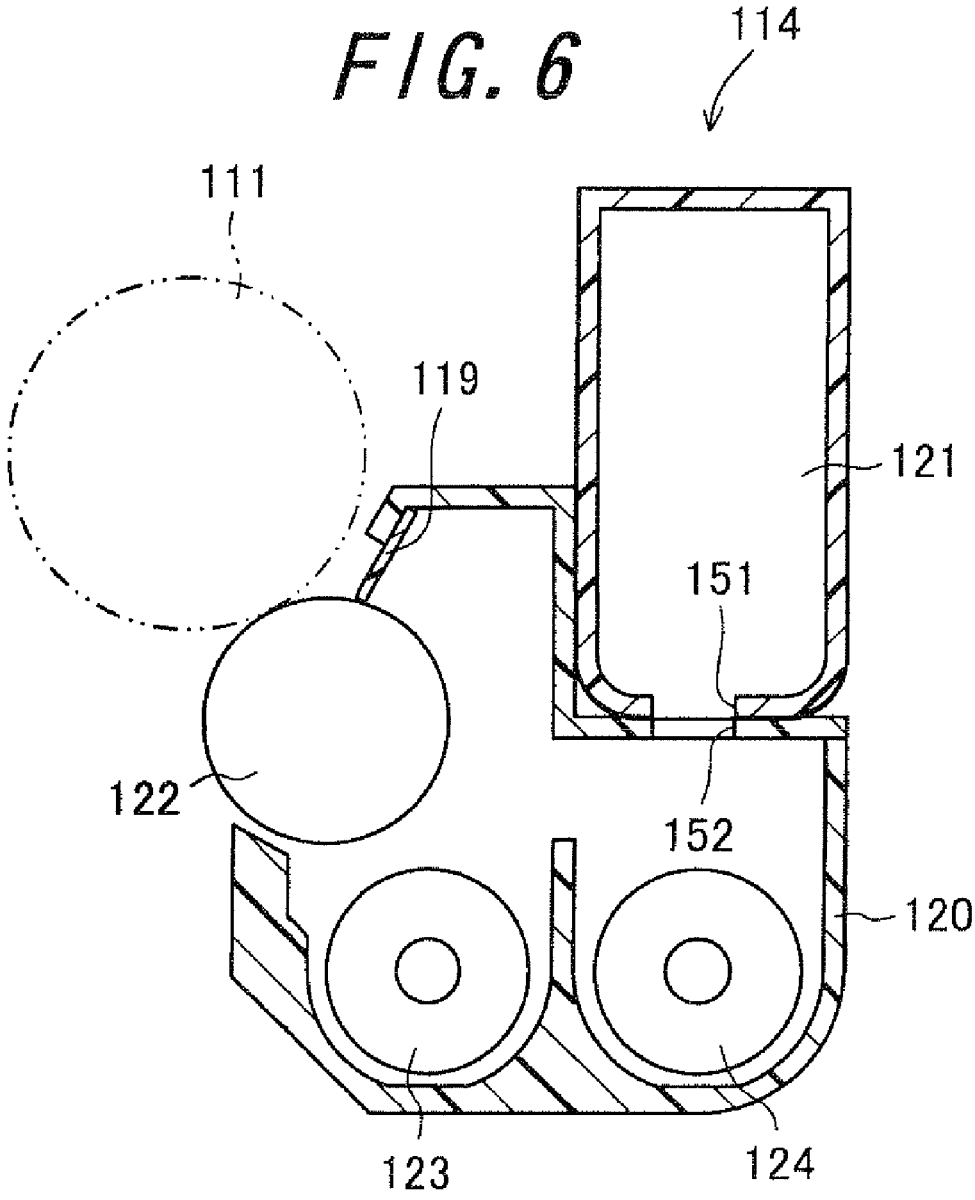
FIG. 6 is a cross sectional view showing constitution of the developing device according to one embodiment of the invention.

FIG. 5 is a schematic constitution view showing constitution of an image forming apparatus 101 provided with a developing device 114, as one embodiment of the invention. FIG. 6 is a cross sectional view showing constitution of the developing device 114 according to one embodiment of the invention. The image forming apparatus 101 of the present embodiment is an electrophotographic image forming apparatus. The image forming apparatus 101 is a multifunction peripheral having a copy function, a print function, and a facsimile function, and forms a full-color or monochrome image on a recording medium in accordance with transmitted image information. That is, the image forming apparatus 101 has three types of printing modes, namely a copy mode, a print mode, and a fax mode. The printing modes can be selected by a control unit (not shown) in accordance with an operation input from an operation portion (not shown), reception of a print job from a personal computer, a mobile terminal apparatus, an information recording and storing medium, an external apparatus using a memory device, and the like. The image forming apparatus 101 includes a toner image forming section 102, a transfer section 103, a fixing section 104, a recording medium feeding section 105, and a discharging section 106.

The image forming apparatus 101 of the present embodiment is constituted so as to be capable of forming multicolor images in which plural toner images having different colors are superimposed. In more details the image forming apparatus 101 of the present embodiment can form multicolor images in which toner images having at least two colors selected from four colors of black (b), cyan (c), magenta (m) and yellow (y) are overlaid. Members constituting the toner image forming section 102 and a part of members included the transfer section 103 are each disposed in the number of four in order to correspond to image information of respective colors of black (b), cyan (c), magenta (m), and yellow (c) contained in color image information. Here, the respective members disposed in the number of 4 to correspond to the respective colors are distinguished by adding alphabets representing the respective colors as suffixes of reference numerals thereof, and are represented only by the reference numerals in case of being collectively called.

The toner image forming part 102 comprises a drum-shaped photoreceptor (hereinafter referred to as "photoreceptor drum") as an image bearing member, a charging portion 112, an exposure unit 113, a developing device 114, and a cleaning unit 115. The charging portion 112 and the exposure unit 113 function as a latent image forming section. The charging portion 112, the developing device 114 and the cleaning unit 115 are arranged around the photoreceptor drum in this order. The charging portion 112 is arranged at a position lower than the developing device 114 and the cleaning unit 115 when viewed in a vertical direction thereof.

The photoreceptor drum 111 is supported and so driven to be rotate about an axis thereof by a driving section (not shown). The photoreceptor drum 111 is composed of a conductive substrate (not shown) and a photosensitive layer (not shown) formed on a surface of the conductive substrate. The conductive substrate can be set to have a variety of shapes, for example, a cylindrical shape, a columnar shape, or a film-sheet shape. Among these shapes, the cylindrical shape is preferred. The conductive substrate is formed of a conductive material. As the conductive material, usable are materials commonly-used in this field, for example, metals such as aluminum, copper, brass, zinc, nickel, stainless steel, chromium, molybdenum, vanadium, indium, titanium, gold, and platinum; an alloy of two or more of the metals just cited; a conductive film obtained by forming a conductive layer composed of one or two or more of aluminum, aluminum alloy, tin oxide, gold, indium oxide, and so forth, on a film-like substrate such as synthetic resin film, metallic film, paper; and a resin composition at least containing either conductive particles and/or conductive polymer; and so forth. Note that, as the film-like substrate used for the conductive film, the synthetic resin film is preferred and polyester film is particularly preferred. Further, deposition, coating, and so on are preferred as a method of forming a conductive layer of the conductive film.

The photosensitive layer is formed by, for example, lamination of a charge generating layer containing a charge generating substance and a charge transporting layer containing a charge transporting substance. In this time, an undercoat layer is preferably designed between the conductive substrate and the charge generating layer or the charge transporting layer. The design of the undercoat layer leads to an advantage of smoothing a surface of the photosensitive layer by coating of flaws and irregularities existent on the surface of the conductive substrate, an advantage of preventing charging property of the photosensitive layer from deteriorating when being repeatedly used, and an advantage of improving the charging property of the photosensitive layer at least either in a low-temperature environment and/or a low-humidity environment. Further, the photosensitive layer may be a three-layer photosensitive layer which is excellent in durability and in which a protective layer for protecting the surface of the photosensitive layer is disposed as a topmost layer. In the present embodiment, the charge generating layer and the charge transporting layer are laminated on the conductive substrate in this order.

The charge generating layer has the charge generating substance for generating charge by light irradiation as a main component, and may contain a known binder resin, plasticizer, sensitizer, etc. according to need. As the charge generating substance, usable are substances commonly-used in this field. Examples of the usable charge generating substance include perylene pigments such as peryleneimide and perylene acid anhydride; polycyclic quinine pigments such as guinacridone and anthraquinone; phthalocyanine pigments such as metallic phthalocyanine and metal-free phthalocyanine, and halogenated metal-free phthalocyanine; squarium pigments; azulenium pigments; thipyrylium pigments; azo pigments having a carbazole skeleton, a styrylstilbene skeleton, a triphenylamine skeleton, a dibenzothiophene skeleton, an oxadiazole skeleton, a fluorenone skeleton, a bisstilbene skeleton, a distyryloxadiazole skeleton, or a distyrylcarbazole skeleton. Among the pigments just cited, pigments which are high in charge generating ability and are suitable for obtaining a high-sensitivity photosensitive layer, are the metal-free phthalocyanine pigments, oxotitanylphthalocyanine pigments, bisazo pigments at least containing either a fluorene ring or a fluorenone ring, bisazo pigments composed of aromatic amine, trisazo pigments, and the like pigments. The charge generating substances may be used each alone, or two or more of the charge generating substances may be used in combination. A content of the charge generating substance is, although not particularly limited, preferably in a range of from 5 parts by weight to 500 parts by weight, and more preferably from 10 parts by weight to 200 parts by weight, based on 100 parts by weight of the binder resin contained in the charge generating layer. As the binder resin for the charge generating layer, usable are binder resins commonly-used in this field, for example, melamine resin, epoxy resin, silicone resin, polyurethane, acrylic resin, vinyl chloride-vinyl acetate copolymer resin, polycarbonate, phenoxy resin, polyvinyl butyral, polyarylate, polyamide, and polyester. The binder resins just cited may be used each alone, or two or more of the binder resins may be used in combination according to need.

Together with the plasticizer, sensitizer, and the like if needed, the charge generating substance and the binder resin are dissolved or dispersed in moderate quantities into an appropriate organic solvent capable of dissolving or dispersing the just-mentioned components, so as to prepare an applying fluid for the charge generating layer. The charge generating layer can be formed by application of the applying fluid for the charge generating layer to the surface of the conductive substrate and subsequent drying of the conductive substrate. A thickness of the charge generating layer as obtained above is, although not particularly limited, preferably in a range of from 0.05 μm to 5 μm, and more preferably from 0.1 μm to 2.5 μm.

The charge transporting layer laminated on the charge generating layer has the charge transporting substance and a binder resin for the charge transporting layer as essential components, and may contain a known antioxidant, plasticizer, sensitizer, lubricant, and so forth according to need. The charge transporting substance is capable of receiving and transporting charges generated from the charge generating substance. As the charge transporting substance, usable are substances commonly-used in this field. Examples of the charge transporting substance include electron-donating substances such as poly-N-vinylcarbazole and its derivatives, poly-γ-carbazolylethylglutamate and its derivatives, pyrene-formaldehyde condensate and its derivatives, polyvinylpyrene, polyvinylphenanthrene, oxazole derivatives, oxadiazolyl derivatives, imidazole derivatives, 9-(p-diethylaminostyril)anthracene, 1,1-bis(4-dibenzylaminophenyl)propane, styrylanthracene, styrylpyrazoline, pyrazoline derivatives, phenylhydrazones, hydrazone derivatives, triphenylamine compounds, tetraphenyldiamine compounds, triphenylmethane compounds, stilbene compounds, azine compounds having a 3-methyl-2-benzothiazolene ring; and electron-accepting substances such as fluorenone derivatives, dibenzothiophene derivatives, indenothiophene derivatives, phenanthrenquinone derivatives, indenopyridine derivatives, thioxanthone derivatives, benzo[c]cinnoline derivatives, phenazineoxide derivatives, tetracyanoethylene, tetracyanoquinodimethane, bromanil, chloranil, benzoquinone. The charge transporting substances just cited may be used each alone, or two or more of the charge transporting substances may be used in combination. A content of the charge transporting substance is, although not particularly limited, preferably in a range of from 10 parts by weight to 300 parts by weight and more preferably from 30 parts by weight to 150 parts by weight, on the basis of 100 parts by weight of the binder resin contained in the charge transporting layer. As the binder resin for the charge transporting layer, usable are binder resins which are commonly-used in this field and capable of uniformly dispersing the charge transporting substance. Examples of the binder resin include polycarbonate, polyallyrate, polyvinyl butyral, polyamide, polyester, polyketone, epoxy resin, polyurethane, polyvinylketone, polystyrene, polyacrylamide, phenol resin, phenoxy resin, polysulfone resin, and copolymer resin of these resins just cited. Considering film-forming property, resistance to abrasion of the charge transporting layer to be obtained, electrical property, and the like property, among these resins are preferred polycarbonate containing bisphenol Z as a monomer component (hereinafter, referred to as "bisphenol-Z polycarbonate") and a mixture of bisphenol-Z polycarbonate and other polycarbonates. The binder resins just cited may be used each alone, or two or more of the binder resins may be used in combination.

In addition to the charge transporting substance and the binder resin for the charge transporting layer, the charge transporting layer preferably contains an antioxidant. As the antioxidant, usable are antioxidants commonly-used in this field, for example, vitamin E, hydroquinone, hindered amine, hindered phenol, para-phenylenediamine, arylalkane, derivatives of these antioxidants just cited, organosulfur compounds, phosphororganic compounds, and so forth. The antioxidants just cited may be used each alone, or two or more of the antioxidants may be used in combination. A content of the antioxidant is, although not particularly limited, preferably in a range of from 0.01% by weight to 10% by weight and more preferably from 0.05% by weight to 5% by weight, based on a sum amount of components constituting the charge transporting layer. Together with the antioxidant, a plasticizer, a sensitizer, and so forth if needed, the charge transporting substance and the binder resin are dissolved or dispersed in moderate quantities into an appropriate organic solvent capable of dissolving or dispersing the just-mentioned components, so as to prepare an applying fluid for the charge transporting layer. The charge transporting layer can be formed by application of the applying fluid for the charge transporting layer to a surface of the charge generating layer and subsequent drying the charge generating layer. A thickness of the charge transporting layer obtained as described above is, although not particularly limited, preferably in a range of from 10 μm to 50 μm, and more preferably from 15 μm to 40 μm. Note that it is possible to form a photosensitive layer in which a charge generating substance and a charge transporting substance are coexistent in one layer. In this case, types and contents of the charge generating substance and the charge transporting substance, types of binder resin, other external additives, etc., may be the same as those used in the case of respectively forming the charge generating layer and the charge transporting layer.

In this embodiment, used is the above-described photoreceptor drum where an organic photosensitive layer is formed by using the charge generating substance and the charge transporting substance. However, as a substitute for the photoreceptor drum 60, it is possible to use a photoreceptor drum where an inorganic photosensitive layer is formed by using silicon or the like. Further, in the present embodiment, the charge generating layer and the charge transporting layer are laminated on the conductive substrate in this order, but those layers may be laminated on the conductive substrate in the order of the charge transporting layer and the charge generating layer.

The charging portion 112 faces the photoreceptor drum 111 and is disposed away from the surface of the photoreceptor drum 111 when viewed in a longitudinal direction of the photoreceptor drum 111. The charging portion 112 charges the surface of the photoreceptor drum 11 so that the surface of the photoreceptor drum 111 has predetermined polarity and potential. As the charging portion 112, it is possible to use a charging brush type charging device, a charger type charging device, a pin array type charging device, an ion-generating device, etc. Although the charging portion 112 is disposed away from the surface of the photoreceptor drum 111 in the embodiment, the configuration is not limited thereto. For example, a charging roller may be used as the charging portion 112, and the charging roller may be disposed in pressure-contact with the photoreceptor drum 12. It is also possible to use a contact-charging type charger such as a charging brush or a magnetic brush.

The exposure unit 113 is disposed so that light beams corresponding to each color information emitted from the exposure unit 113 pass between the charging portion 112 and the developing device 114 and reach the surface of the photoreceptor drum 111. In the exposure unit 113, the image information is converted into light beams corresponding to each color information of black (b), cyan (c), magenta (m), and yellow (y), and the surface of the photoreceptor drum 111 which has been evenly charged by the charging portion 112, is exposed to the light beams corresponding to each color information to thereby form electrostatic latent images on the surfaces of the photoreceptor drums 111. As the exposure unit 113, it is possible to use a laser scanning unit having a laser-emitting portion and a plurality of reflecting mirrors. The other usable examples of the exposure unit 113 may include an LED array and a unit in which a liquid-crystal shutter and a light source are appropriately combined with each other.

The developing device 114 includes, as shown in FIG. 6, developer regulation blade 119, a developing tank 120, a toner hopper 121, a developing roller 122, a supply roller 123, and a stirring roller 124. The developing tank 120 is a container-like member and is so disposed as to face the surface of the photoreceptor drum 111. The developing tank 120 houses the toner therein, and further houses and rotatably supports the developing roller 122, the supply roller 123 and the stirring roller 124. The developing tank 120 has an opening port formed in its side surface facing the photoreceptor drum 111. The developing roller 122 is rotatably disposed at a position facing the photoreceptor drum 111 via the opening port.

The developing roller 122 is a developer transport bearing member which bears and transports the developer. The developer roller 122 is a so-called magnet roller and includes a fixed magnetic body therein. The carrier in the developer is magnetically adsorbed on the developing roller 122 by magnetic force of the fixed magnetic body, thereby the developer is supported on the developing roller 122. The developing roller 122 is a roller-shaped member, and supplies a toner to an electrostatic latent image on the surface of the photoreceptor drum 111 in a pressure-contact portion part or a proximal portion located between the photoreceptor drum 111 and the developing roller 122. In supplying the toner, voltage having reverse polarity to the charged voltage of the toner is applied as development bias voltage to the surface of the development roller 122. By doing so, the toner on the surface of the development roller 122 is smoothly supplied to an electrostatic latent image. Furthermore, the amount of a toner supplied to the electrostatic latent image (toner attachment amount) can be controlled by changing a value of the development bias voltage. The amount of a developer borne on the surface of the development roller 122 is regulated by the developer regulation blade 119. The developing device 114 supplies the toner to an electrostatic latent image formed on the surface of the photoreceptor drum 111 by the development roller 122 to perform development, thereby a toner image as a visible image is formed.

The supply roller 123 is a roller-like member, and is rotatably disposed to face the developing roller 122 and supplies the toner to the vicinity of the developing roller 122. The stirring roller 124 is a roller-like member, and is rotatably disposed to face the supply roller 123 and stirs a toner newly-supplied into the developing tank 120 from the toner hopper 121 and a toner having been stored in the developing tank 120, and delivers it to the vicinity of the supply roller 123. The supply roller 123 functions as a supply section which supplies the toner to the development roller 122, and the stirring roller 124 is a stirring and delivering section which stirs the toner in the development tank 120 and delivers the same to the supply roller 123 as a supply part. The supply section and the stirring and delivering section are a roller-shaped member in this embodiment. However, those are not limited to the roller-shaped member, and may be, for example, a screw-shaped member.

The toner hopper 121 is so disposed that a toner replenishment port (not shown) provided in a bottom of the toner hopper 151 when viewed in a vertical direction thereof is in communication with a toner receiving port (not shown) provided in the top of the developing tank 152 when viewed in a vertical direction thereof. The toner hopper 121 replenishes the toner in accordance with a toner assumption situation in the developing tank 120. In addition, a design may be used where the toner hopper 121 is not disposed and the toner is directly replenished from toner cartridges of the respective colors.

Returning to FIG. 5, the cleaning unit 115 removes the toner remaining left on the surface of the photoreceptor drum 111 and cleans the surface of the photoreceptor drum 111 after the toner image has been transferred to the recording medium. As the cleaning unit 115, usable is a plate-like member such as a cleaning blade, for example. Note that deterioration in surface easily occurs due to a chemical action of ozone resulted from corona discharge of the charging apparatus, since an organic photoreceptor drum is mainly used as the photoreceptor drum 111 in the image forming apparatus 1 of the invention and the surface of the organic photoreceptor drum is mainly composed of resin. However, the deteriorated part of the surface can be worn by an abrading behavior of the cleaning unit 115 and is slowly but reliably removed. Accordingly, the problem of the surface deterioration caused by the ozone or the like can be actually resolved, and the charged potential charged by a charging operation can be stably maintained for a prolonged period of time. While the cleaning unit 115 is disposed in the embodiment, the cleaning unit 115 is not indispensable.

In the toner image forming section 102, the image-information-based signal lights are irradiated from the exposure unit 113 onto the surface of the photoreceptor drum 111 uniformly-charged by the charging portion 112 so that the electrostatic latent image is formed thereon, and the toner is thereafter fed from the developing device 114 to the electrostatic latent image to form a toner image which is then transferred to an intermediate transfer belt 125. And then, the toner remaining left on the surface of the photoreceptor drum 111 is removed by the cleaning unit 115. This series of toner-forming operations as described above are repeatedly carried out.

The transfer section 103 is disposed above the photoreceptor drum 111 and includes the intermediate transfer belt 125, a driving roller 126, a driven roller 127, intermediate transfer rollers 128*b*, 128*c*, 128*m*, 128*y*, a transfer belt cleaning unit 129, and a transfer roller 130.

The intermediate transfer belt 125 is an endless belt stretched between the driving roller 126 and the driven roller 127, thereby forming a loop-shaped travel path. The intermediate transfer belt 125 rotates in an arrow B direction. When the intermediate transfer belt 125 passes by the photoreceptor drum 111 in contact therewith, the transfer bias voltage whose polarity is opposite to the polarity of the charged toner on the surface of the photoreceptor drum 11 is applied from the intermediate transfer roller 128 which is disposed opposite to the photoreceptor drum 111 across the intermediate transfer belt 125, with the result that the toner image formed on the surface of the photoreceptor drum 111 is transferred onto the intermediate transfer belt 125. In the case of a multicolor image, the toner images of respective colors formed on the respective photoreceptor drums 111 are sequentially transferred and overlaid onto the intermediate transfer belt 125, thus forming a multicolor toner image.

The driving roller 126 can rotate around an axis thereof with the aid of a driving section (not shown), and the rotation of the driving roller 126 drives the intermediate transfer belt 125 to rotate in the arrow B direction. The driven roller 127 can be driven to rotate by the rotation of the driving roller 126, and imparts constant tension to the intermediate transfer belt 125 so that the intermediate transfer belt 125 does not go slack. The intermediate transfer roller 128 is disposed in pressure-contact with the photoreceptor drum 111 across the intermediate transfer belt 125, and capable of rotating around its own axis by a driving section (not shown). The intermediate transfer roller 128 is connected to a power source (not shown) for applying the transfer bias voltage as described above and has a function of transferring the toner image on the surface of the photoreceptor drum 111 onto the intermediate transfer belt 125.

The transfer belt cleaning unit 129 is disposed opposite to the driven roller 127 across the intermediate transfer belt 125 so as to come into contact with an outer circumferential surface of the intermediate transfer belt 125. The residual toner which is attached to the intermediate transfer belt 125, which is caused by contact of the intermediate transfer belt 125 with the photoreceptor drum 111, may cause contamination on a reverse side of the recording medium, the transfer belt cleaning unit 129 removes and collects the toner on the surface of the intermediate transfer belt 125.

The transfer roller 130 is disposed in pressure-contact with the driving roller 126 across the intermediate transfer belt 125, and capable of rotating around its own axis by a driving section (not shown). In a pressure-contact portion (a transfer nip portion) between the transfer roller 130 and the driving roller 126, a toner image which has been carried by the intermediate transfer belt 125 and thereby conveyed to the pressure-contact portion is transferred onto a recording medium fed from the later-described recording medium feeding section 105. The recording medium bearing the toner image is fed to the fixing section 104. In the case that multicolor images are formed on the intermediate transfer belt 125, the multicolor images formed are collectively transferred to a recording medium by the transfer roller 130. The recording medium having the toner image thus transferred is sent to the fixing part 104.

In the transfer section 103, the toner image is transferred from the photoreceptor drum 111 onto the intermediate transfer belt 125 in the pressure-contact portion between the photoreceptor drum 111 and the intermediate transfer roller 128, and by the intermediate transfer belt 125 rotating in the arrow B direction, the transferred toner image is conveyed to the transfer nip portion where the toner image is transferred onto the recording medium.

The fixing section 104 is provided downstream of the transfer section 103 along a conveyance direction of the recording medium, and contains a fixing roller 131 and a pressure roller 132. The fixing roller 131 can rotate by a driving section (not shown), and heats the toner constituting an unfixed toner image borne on the recording medium so that the toner is fused to be fixed on the recording medium. Inside the fixing roller 131 is provided a heating portion (not shown). The heating portion heats the heating roller 131 so that a surface of the heating roller 131 has a predetermined temperature (heating temperature). For the heating portion, a heater, a halogen lamp, and the like device can be used, for example. The heating portion is controlled by a fixing condition control portion. In the vicinity of the surface of the fixing roller 131 is provided a temperature detecting sensor which detects a surface temperature of the fixing roller 131. A result detected by the temperature detecting sensor is written to a memory portion of the later-described control unit.

The pressure roller 132 is disposed in pressure-contact with the fixing roller 131, and supported so as to be rotatably driven by the rotation of the fixing roller 31. The pressure roller 132 helps the toner image to be fixed onto the recording medium by pressing the toner and the recording medium when the toner is fused to be fixed on the recording medium by the fixing roller 131. A pressure-contact portion between the fixing roller 131 and the pressure roller 132 is a fixing nip portion. In the fixing section 104, the recording medium onto which the toner image has been transferred in the transfer section 103 is nipped by the fixing roller 131 and the pressure roller 132 so that when the recording medium passes through the fixing nip portion, the toner image is pressed and thereby fixed onto the recording medium under heat, whereby an image is formed.

The recording medium feeding section 105 includes an automatic paper feed tray 135, a pickup roller 136, conveying rollers 137, registration rollers 138, and a manual paper feed tray 139. The automatic paper feed tray 135 is disposed in a vertically lower part of the image forming apparatus and in form of a container-shaped member for storing the recording mediums. Examples of the recording medium include plain paper, color copy paper, sheets for overhead projector, and postcards. The pickup roller 136 takes out sheet by sheet the recording mediums stored in the automatic paper feed tray 135, and feeds the recording mediums to a paper conveyance path S1.

The conveying rollers 137 are a pair of roller members disposed in pressure-contact with each other, and convey the recording medium to the registration rollers 138. The registration rollers 138 are a pair of roller members disposed in pressure-contact with each other, and feed to the transfer nip portion the recording medium fed from the conveying rollers 137 in synchronization with the conveyance of the toner image borne on the intermediate transfer belt 125 to the transfer nip portion.

The manual paper feed tray 139 is a device storing recording mediums which are different from the recording mediums stored in the automatic paper feed tray 135 and may have any size and which are to be taken into the image forming apparatus, and the recording medium taken in from the manual paper feed tray 139 passes through a paper conveyance path S2 by use of the conveying rollers 137, thereby being fed to the registration rollers 138. In the recording medium feeding section 105, the recording medium supplied sheet by sheet from the automatic paper feed tray 135 or the manual paper feed tray 139 is fed to the transfer nip portion in synchronization with the conveyance of the toner image borne on the intermediate transfer belt 125 to the transfer nip portion.

The discharging section 106 includes the conveying rollers 137, discharging rollers 140, and a catch tray 141. The conveying rollers 137 are disposed downstream of the fixing nip portion along the paper conveyance direction, and convey toward the discharging rollers 140 the recording medium onto which the image has been fixed by the fixing section 104. The discharging rollers 140 discharge the recording medium onto which the image has been fixed, to the catch tray 141 disposed on a vertically upper surface of the image forming apparatus. The catch tray 141 stores the recording medium onto which the image has been fixed.

The image forming apparatus 101 includes the control unit (not shown). The control unit is, for example, internally disposed in an upper part of the image forming apparatus 101 and includes a memory portion, a computing portion, and a control portion. Into the memory portion of the control unit are inputted various setting values through an operation panel (not shown) which is disposed in an upper part of the image forming apparatus 101, detection results from sensors (not shown) etc. internally disposed in different parts of the image forming apparatus 101, image information from an external apparatus, and so forth. Further, programs for executing various functional elements are written in the memory portion.

The various functional elements refer to, for example, a recording medium determining portion, an attachment-amount control portion, the fixing-condition control portion, and so forth.

As for the memory portion, usable are components commonly-used in this field, for example, a read-only memory (ROM), a random access memory (RAM), a hard disk driver (HDD), and so forth. As the external apparatus, usable is an electrical/electronic apparatus which is capable of creating or acquiring the image information and is electrically connectable to the image forming apparatus 101. Examples of the external apparatus include a computer, a digital camera, a television receiver, a video recorder, a DVD (digital versatile disc) recorder, an HDDVD (high-definition digital versatile disc), a blu-ray disc recorder, a facsimile device, a mobile terminal device, and so forth.

The computing portion takes out the various data (an image-forming command, a detection result, and image information, and so forth) written in the memory portion and programs for the various functional elements, so as to perform various determinations. The control portion sends a control signal to a corresponding device in accordance with a result determined by the computing portion, so as to perform an operation control. Both the control portion and the computing portion include a processing circuit achieved by a microcomputer, a microprocessor, and the like each having a central processing unit (CPU). The control unit includes a main power source in addition to the above-described processing circuit, and an electric power is supplied to both the control unit and different devices located inside the image forming apparatus 101.

According to the present embodiment mentioned above, the developing device 114 develops the electrostatic latent image formed on the photoreceptor drum 111 by using the developer of the invention to form the toner image. The developer of the invention includes the toner of the invention in which the individual toner particles are appropriately charged and generation of fogging to a white background area of a recording medium, selective development and generation of scattering can be prevented and is excellent in cleanability and transferability. Therefore, it is possible to form a high-quality toner image without fogging of the non-image area. Since the developing device 114 develops the electrostatic latent image by using such a developer of the invention, it is possible to form a high-quality toner image on the photoreceptor drum 111 stably. The developing device 114 capable of forming a high-quality image having high definition and high resolution is implemented.

Since the development is carried out by such a developing device 114 in the present embodiment, it is possible to implement the image forming apparatus 101 capable of forming a high-quality image without fogging of the non-image area.

The image forming apparatus 101 of the present embodiment is a multifunctional peripheral having copying function, printer function and facsimile function in combination, but is not limited to this, and may be used as, for example, a copying machine, a printer or a facsimile apparatus.

EXAMPLES

The invention is specifically described below by referring to examples and comparative examples, but the invention is not particularly limited to those as far as not exceeding the gist of the invention. In the following examples and comparative examples, unless otherwise particularly indicated, parts and % mean parts by weight and % by weight, respectively. Furthermore, in the examples and comparative examples, volume particle sizes ($D_{75V}$, $D_{25V}$ and $D_{50V}$) of the toner and the shape factor of the toner were measured as follows.

[Volume Particle Size of Toner ($D_{75V}$, $D_{25V}$, $D_{50V}$]

A volume average particle size of a toner was determined from the particle size distribution of toner particles measured in the above measurement condition by use of COULTER MULTISIZER III manufactured by Beckman Coulter, Inc.

[Shape Factors SF-1 and SF-2 of Toner]

2.0 g of a toner, 1 ml of a sodium alkyl ether sulfate and 50 ml of pure water were added to a 100 ml beaker, and well stirred to prepare a toner dispersion. The toner dispersion was treated with a supersonic homogenizer (manufactured by Nihonseiki Kabushiki Kaisha Ltd.) at an output of 50 μA for 5 minutes, and then further dispersed. The dispersion was allowed to stand for 6 hours, and a supernatant was removed. 50 ml of pure water was added to the dispersion, followed by stirring with a magnetic stirrer for 5 minutes, and suction filtration was then conducted using a membrane filter (opening diameter: 1 μm). Washed material on the membrane filter was vacuum dried in a desiccator containing silica gel therein about overnight to obtain the objective toner.

A metal film (Au film, thickness: 0.5 μm) was formed on the thus washed surface of the toner particles with sputter deposition. 200 to 300 metal film-coated toners were extracted at random from the metal film-coated toners with a scanning electron microscope (trade name: S-570, manufactured by Hitachi, Ltd.) at an accelerating voltage of 5 kV and at 1,000 magnifications, and photographed. The electron microscope photograph data are image analyzed with an image analysis software (trade name: Azokun, manufactured by Asahi Kasei Engineering Corporation), and the shape factor was calculated and obtained therefrom.

Example 1

The second pulverized material having a large average particle size was spheronized using an impact type spheronizer (trade name: FACULTY F-400, Hosokawa Micron Corporation), and excessively-pulverized toner was classified and removed with a rotary classifier to obtain a second toner particle group. The first pulverized material having a small average particle size was treated with a rotary classifier to classify and remove excessively-pulverized toner, thereby obtaining a first toner particle group. Those toner particle groups were mixed in the proportion of (first toner particle group):(second toner particle group)=100:30. 2.2 parts of hydrophobic silica (trade name: R-974, manufactured by Nippon Aerosil Co., Ltd.), 1.6 parts of hydrophobic silica (trade name: T-805, manufactured by Nippon Aerosil Co., Ltd.), the total being 3.8 parts by weight, as external additives were mixed with Henschel mixer (trade name: FM mixer, manufactured by Mitsui Mining Co., Ltd.) and externally added to prepare toner particles of Example 1. In this case, a volume particle average particle size was 6.0 μm, a shape factor SF-1 was 154, SF-2 was 143, SF-2 of particles of $D_{75V}$ or less was 144, and SF-2 of particles of $D_{25V}$ or more was 141.

Example 2

A toner was prepared in the same procedures as in Example 1, except for changing pulverization, classification and spheronization conditions of the second toner particle group. Thus, the toner of Example 2 in which a volume particle average particle size was 5.6 μm, a shape factor SF-1 was 155, SF-2 was 144, SF-2 of particles of $D_{75V}$ or less was 144, and SF-2 of particles of $D_{25V}$ or more was 142 was obtained.

Example 3

A toner was prepared in the same procedures as in Example 1, except for changing the mixing proportion to 100:10. Thus, the toner of Example 3 in which a volume particle average particle size was 5.5 μm, a shape factor SF-1 was 154, SF-2 was 143, SF-2 of particles of $D_{75V}$ or less was 144, and SF-2 of particles of $D_{25V}$ or more was 135 was obtained.

Example 4

A toner was prepared in the same procedures as in Example 1, except for changing pulverization, classification and spheronization conditions of the first and second toner particle groups. Thus, the toner of Example 4 in which a volume particle average particle size was 5.1 μm, a shape factor SF-1 was 150, SF-2 was 141, SF-2 of particles of $D_{75V}$ or less was 141, and SF-2 of particles of $D_{25V}$ or more was 139 was obtained.

Example 5

A toner was prepared in the same procedures as in Example 1, except for changing pulverization, classification and spheronization conditions of the first and second toner particle groups. Thus, the toner of Example 5 in which a volume particle average particle size was 7.4 μm, a shape factor SF-1 was 158, SF-2 was 148, SF-2 of particles of $D_{75V}$ or less was 149, and SF-2 of particles of $D_{25V}$ or more was 140 was obtained.

Example 6

A toner was prepared in the same procedures as in Example 1, except for changing pulverization, classification and spheronization conditions of the first and second toner particle groups. Thus, the toner of Example 6 in which a volume particle average particle size was 6.8 μm, a shape factor SE-1 was 155, SF-2 was 147, SF-2 of particles of $D_{75V}$ or less was 149, and SF-2 of particles of $D_{25V}$ or more was 135 was obtained.

Example 7

A toner was prepared in the same procedures as in Example 1, except for changing pulverization, classification and spheronization conditions of the second toner particle group. Thus, the toner of Example 7 in which a volume particle average particle size was 6.0 μm, a shape factor SF-1 was 157, SF-2 was 145, SF-2 of particles of $D_{75V}$ or less was 144, and SF-2 of particles of $D_{25V}$ or more was 145 was obtained.

Example 8

A toner was prepared in the same procedures as in Example 1, except for changing pulverization, classification and spheronization conditions of the first and second toner particle groups. Thus, the toner of Example 8 in which a volume particle average particle size was 4.4 μm, a shape factor SF-1 was 150, SF-2 was 141, SF-2 of particles of $D_{75V}$ or less was 141, and SF-2 of particles of $D_{25V}$ or more was 140 was obtained.

Example 9

A toner was prepared in the same procedures as in Example 1, except for changing pulverization, classification and spheronization conditions of the first toner particle group. Thus, the toner of Example 9 in which a volume particle average particle size was 8.0 μm, a shape factor SF-1 was 158, SF-2 was 148, SF-2 of particles of $D_{75V}$ or less was 149, and SF-2 of particles of $D_{25V}$ or more was 141 was obtained.

Example 10

A toner was prepared in the same procedures as in Example 1, except for changing pulverization, classification and spheronization conditions of the first and second toner particle groups. Thus, the toner of Example 10 in which a volume particle average particle size was 4.3 μm, a shape factor SF-1 was 149, SF-2 was 141, SF-2 of particles of $D_{75V}$ or less was 141, and SF-2 of particles of $D_{25V}$ or more was 139 was obtained.

Example 11

A toner was prepared in the same procedures as in Example 1, except for changing pulverization, classification and spheronization conditions of the first and second toner particle groups. Thus, the toner of Example 11 in which a volume particle average particle size was 8.0 μm, a shape factor SF-1 was 163, SF-2 was 148, SF-2 of particles of $D_{75V}$ or less was 149, and SF-2 of particles of $D_{25V}$ or more was 145 was obtained.

Example 12

A toner was prepared in the same procedures as in Example 1, except for charging pulverization, classification and spheronization conditions of the first and second toner particle groups. Thus, the toner of Example 12 in which a volume particle average particle size was 4.2 μm, a shape factor SF-1 was 151, SF-2 was 141, SF-2 of particles of $D_{75V}$ or less was 141, and SF-2 of particles of $D_{25V}$ or more was 140 was obtained.

Example 13

A toner was prepared in the same procedures as in Example 1, except for changing pulverization, classification and spheronization conditions of the first and second toner particle groups. Thus, the toner of Example 13 in which a volume particle average particle size was 7.9 μm, a shape factor SF-1 was 159, SF-2 was 148, SF-2 of particles of $D_{75V}$ or less was 149, and SF-2 of particles of $D_{25V}$ or more was 142 was obtained.

Example 14

A toner was prepared in the same procedures as in Example 1, except for changing pulverization, classification and spheronization conditions of the first and second toner particle groups. Thus, the toner of Example 14 in which a volume particle average particle size was 3.9 μm, a shape factor SF-1 was 1.55, SF-2 was 143, SF-2 of particles of $D_{75V}$ or less was 143, and SF-2 of particles of $D_{25V}$ or more was 143 was obtained.

Example 15

A toner was prepared in the same procedures as in Example 1, except for changing pulverization, classification and spheronization conditions of the first and second toner particle groups. Thus, the toner of Example 15 in which a volume particle average particle size was 8.1 μm, a shape factor SF-1 was 159, SF-2 was 149, SF-2 of particles of $D_{75V}$ or less was 149, and SF-2 of particles of $D_{25V}$ or more was 150 was obtained.

Example 16

A toner was prepared in the same procedures as in Example 1, except for changing the amount of the release agent compounded such that the content of the release agent was 3.0%, and changing pulverization, classification and spheronization conditions of the first and second toner particle groups. Thus, the toner of Example 16 in which a volume particle average particle size was 6.0 μm, a shape factor SF-1 was 151, SF-2 was 142, SF-2 of particles of $D_{75V}$ or less was 143, and SF-2 of particles of $D_{25V}$ or more was 138 was obtained.

Example 17

A toner was prepared in the same procedures as in Example 1, except for changing the amount of the release agent compounded such that the content of the release agent was 10.0%, and changing pulverization, classification and spheronization conditions of the first and second toner particle groups. Thus, the toner of Example 17 in which a volume particle average particle size was 6.1 μm, a shape factor SF-1 was 152, SF-2 was 141, SF-2 of particles of $D_{75V}$ or less was 141, and SF-2 of particles $D_{25V}$ or more was 140 was obtained.

Example 18

A toner was prepared in the same procedures as in Example 1, except for changing the amount of the release agent compounded such that the content of the release agent was 2.5%, and changing pulverization, classification and spheronization conditions of the first and second toner particle groups. Thus, the toner of Example 18 in which a volume particle average particle size was 6.0 μm, a shape factor SF-1 was 155, SF-2 was 145, SF-2 of particles of $D_{75V}$ or less was 145, and SF-2 of particles of $D_{25V}$ or more was 135 was obtained.

Example 19

A toner was prepared in the same procedures as in Example 1, except for changing the amount of the release agent compounded such that the content of the release agent was 11.0%, and changing pulverization, classification and spheronization conditions of the first and second toner particle groups. Thus, the toner of Example 19 in which a volume particle average particle size was 5.9 μm, a shape factor SF-1 was 153, SF-2 was 141, SF-2 of particles of $D_{75V}$ or less was 141, and SF-2 of particles of $D_{25V}$ or more was 141 was obtained.

Comparative Example 1

A toner was prepared in the same procedures as in Example 1, except for changing pulverization, classification and spheronization conditions of the first and second toner particle groups. Thus, the toner of Comparative Example 1 in which a volume particle average particle size was 7.5 μm, a shape factor SF-1 was 158, SF-2 was 147, SF-2 of particles of $D_{75V}$ or less was 149, and SF-2 of particles of $D_{25V}$ or more was 131 was obtained.

Comparative Example 2

A toner was prepared in the same procedures as in Example 1, except for changing pulverization, classification and spheronization conditions of the second toner particle group. Thus, the toner of Comparative Example 2 in which a volume particle average particle size was 6.6 μm, a shape factor SF-1 was 155, SF-2 was 146, SF-2 of particles of $D_{75V}$ or less was 144, and SF-2 of particles of $D_{25V}$ or more was 150 was obtained.

Comparative Example 3

A toner was prepared in the same procedures as in Example 1, except for changing pulverization, classification and spheronization conditions of the first toner particle group. Thus, the toner of Comparative Example 3 in which a volume particle average particle size was 5.2 μm, a shape factor SF-1 was 150, SF-2 was 139, SF-2 of particles of $D_{75V}$ or less was 139, and SF-2 of particles of $D_{25V}$ or more was 141 was obtained.

Comparative Example 4

A toner was prepared in the same procedures as in Example 1, except for changing pulverization, classification and spheronization conditions of the first and second toner particle groups. Thus, the toner of Comparative Example 4 in which a volume particle average particle size was 4.1 μm, a shape factor SF-1 was 162, SF-2 was 150, SF-2 of particles of $D_{75V}$ or less was 152, and SF-2 of particles of $D_{25V}$ or more was 140 was obtained.

Comparative Example 5

A toner was prepared in the same procedures as in Example 1, except for changing pulverization, classification and spheronization conditions of the first and second toner particle groups. Thus, the toner of Comparative Example 5 in which a volume particle average particle size was 5.8 m, a shape factor SF-1 was 152, SF-2 was 140, SF-2 of particles of $D_{75V}$ or less was 143, and SF-2 of particles of $D_{25V}$ or more was 135 was obtained.

Properties or the toners obtained in Examples 1 to 19 and Comparative Examples 1 to 5 above are shown in Table 1.

TABLE 1

| | Shape factor | | | | | Volume average | Content of release |
|---|---|---|---|---|---|---|---|
| | SF-2(a) ($D_{75V}$ or less) | SF-2(b) ($D_{25V}$ or more) | SF-2(b)/ SF-2(a) | SF-2 (Average) | SF-1 | particle size (μm) | agent (wt %) |
| Example 1 | 144 | 141 | 0.98 | 143 | 154 | 6.0 | 5.0 |
| Example 2 | 144 | 142 | 0.99 | 144 | 155 | 5.6 | 5.0 |
| Example 3 | 144 | 135 | 0.94 | 143 | 154 | 5.5 | 5.0 |
| Example 4 | 141 | 139 | 0.99 | 141 | 150 | 5.1 | 5.0 |
| Example 5 | 149 | 140 | 0.94 | 148 | 158 | 7.4 | 5.0 |
| Example 6 | 149 | 135 | 0.91 | 147 | 155 | 6.8 | 5.0 |
| Example 7 | 144 | 145 | 1.01 | 145 | 157 | 6.0 | 5.0 |

TABLE 1-continued

| | Shape factor | | | | | Volume average | Content of release |
|---|---|---|---|---|---|---|---|
| | SF-2(a) ($D_{75V}$ or less) | SF-2(b) ($D_{25V}$ or more) | SF-2(b)/ SF-2(a) | SF-2 (Average) | SF-1 | particle size (μm) | agent (wt %) |
| Example 8 | 141 | 140 | 0.99 | 141 | 150 | 4.4 | 5.0 |
| Example 9 | 149 | 141 | 0.95 | 148 | 158 | 8.0 | 5.0 |
| Example 10 | 141 | 139 | 0.99 | 141 | 149 | 4.3 | 5.0 |
| Example 11 | 149 | 145 | 0.97 | 148 | 163 | 8.0 | 5.0 |
| Example 12 | 141 | 140 | 0.99 | 141 | 151 | 4.2 | 5.0 |
| Example 13 | 149 | 142 | 0.95 | 148 | 159 | 7.9 | 5.0 |
| Example 14 | 143 | 143 | 1.00 | 143 | 155 | 3.9 | 5.0 |
| Example 15 | 149 | 150 | 1.01 | 149 | 159 | 8.1 | 5.0 |
| Example 16 | 143 | 138 | 0.97 | 142 | 151 | 6.0 | 3.0 |
| Example 17 | 141 | 140 | 0.99 | 141 | 152 | 6.1 | 10.0 |
| Example 18 | 145 | 135 | 0.93 | 145 | 155 | 6.0 | 2.5 |
| Example 19 | 141 | 141 | 1.00 | 141 | 153 | 5.9 | 11.0 |
| Comparative Example 1 | 149 | 131 | 0.88 | 147 | 158 | 7.5 | 5.0 |
| Comparative Example 2 | 144 | 150 | 1.04 | 146 | 155 | 6.6 | 5.0 |
| Comparative Example 3 | 139 | 141 | 1.01 | 139 | 150 | 5.2 | 5.0 |
| Comparative Example 4 | 152 | 140 | 0.92 | 150 | 162 | 4.1 | 5.0 |
| Comparative Example 5 | 143 | 135 | 0.94 | 140 | 152 | 5.8 | 5.0 |

<Evaluation 1>

Flowability was evaluated on the toners obtained in Examples 1 to 19 and Comparative Examples 1 to 5 as follows.

[Bulk Specific Density]

Bulk specific gravity of the toner was measured as follows. Using a bulk specific gravity measuring instrument (JIS bulk specific gravity measuring instrument, manufactured by Tsutsui Scientific Instruments Co., Ltd.), bulk specific gravity was measured according to JIS K-5101-12-1 (general test method of measuring apparent density or apparent specific volume of pigment or extender pigment by a loose packing method). Flowability is good as the value of bulk specific gravity is large.

<Evaluation 2>

Each of the toners obtained in Examples 1 to 19 and Comparative Examples 1 to 5 and a ferrite core carrier having a volume average particle size of 45 μm were mixed with a V shaped mixer (trade name V-5, manufacture by Tokuju Corporation) for 20 minutes such that the surface coverage of the toner to the carrier was 60%, thereby preparing two-component developers.

Evaluation was conducted on cleanability, selective development, fixability, transfer efficiency, void and resolution using the two-component developer obtained.

[Cleaning Property]

A pressure of a cleaning blade was adjusted so that an initial linear pressure attained to 25 gf/cm ($2.45\times10^{-1}$ N/cm), wherein the pressure of the cleaning blade refers to a pressure occurring when the cleaning blade of a cleaning unit disposed in the commercially-available copier (trade name: MX-2300G; manufactured by Sharp Corporation) makes abutment-contact with the photoreceptor drum. This copier was filed with the two-component developers respectively. By using such a copier as just described, 50,000 copies of a character text chart created by Sharp Corporation were made at 25° C. and at 50% relative humidity, so as to determine the cleaning property.

By confirming a formed image by eye before the image formed (an initial stage), after 10,000 (10K) copies were made, and after 50,000 (50K) copies were made, a test was conducted on definition of a boundary located between an image area and a non-image area, as well as on existence or nonexistence of a black streak formed by leakage of toner in a rotation direction of the photoreceptor drum. Further, an amount of fogging Wk of the formed image was determined by a later-described measuring device. The cleaning property was thus evaluated.

A reflection density was measured by using Z-Σ90 COLOR MEASURING SYSTEM manufactured by Nippon Denshoku Industries Co., Ltd. and the amount of fogging Wk of the formed image was determined as follows. First of all, a reflection average density Wr of recording paper was measured prior to image formation. Then, after an image was formed by a recording portion, reflection densities were measured at different white parts of the recording paper. A value was determined according to the following expression (3), on the basis of the above-described Wr and a reflection density Ws of a part greatest in fogging amount, namely a white part highest in density. The value thus determined was defined as the amount of fogging Wk (%). Evaluation criteria are as follows.

$$Wk=100\times((Ws-Wr)/Wr) \quad (3)$$

Excellent: Very favorable. The definition is good and no black streak occurs. And the amount of fogging Wk is less than 3%.

Good: Favorable. The definition is good and no black streak occurs. And the amount of fogging Wk is 3% or more and less than 5%.

Not bad: No problem in practical use. The definition basically does not induce a problem in practical use and the break streaks is 2.0 mm or less in length and 5 pieces or less in number. And the amount of fogging Wk is 5% or more and less than 10%.

Poor: Unusable in practice. There exists a problem in definition in practical use. The black streaks are at least either greater than 2.0 mm in length or 6 pieces or more in number. And the amount of fogging Wk is 10% or more.

[Selective Development]

The respective two-component developers were charged in the commercially available copying machine (trade name: MX-2300G, manufactured by Sharp Corporation), and character test chart, manufactured by Sharp Corporation was formed on 5,000 recording sheets of paper in normal temperature and normal moisture environment of a temperature of 25° C. and relative humidity of 50%. Particle size distribution of toner particles in the two-component developer before image formation (initial) and after printing 5,000 sheets of paper (5K sheets) was measured with Coulter Multisizer III (manufactured by Beckman Coulter, Inc.), and selective development was evaluated by the variation in volume average particle size before and after printing. The evaluation standard is as follows.

Excellent: Very favorable. Variation of volume average particle size is less than 0.1 μm.

Good: Favorable. Variation of volume average particle size is from 0.1 to less than 0.2 μm.

Not bad: No problem in practical use. Variation of volume average particle size is from 0.2 to less than 0.3 μm.

Poor: Unusable in practice. Variation of volume average particle size is 0.3 μm or more.

[Dot Scattering]

The two-component developer containing a toner was charged in the commercially available copying machine (trade name: MX-2300G, manufactured by Sharp Corporation), the amount of the toner adhered on a photoreceptor was adjusted to be 0.4 mg/cm$^2$, an image of 3×5 isolated dots was formed. The image of 3×5 isolated dots is an image that plural dot parts having a size of 3 dots in vertical size and 3 dots in horizontal size are formed in 600 dpi (dot per inch) such that distance between the adjacent dot parts is 5 dots. The image formed was enlarged in 200 magnifications with an optical microscope (trade name: VHX-600, manufactured by Keyence Corporation), and scatters around the dot (3×3) were visually counted to judge the dot scattering. The evaluation standard is as follows.

Excellent: Very Favorable. The number of toners scattered are less than 20.

Good: Favorable. The number of toners scattered are from 20 to less than 30.

Not bad: No problem in practical use. The number of toners scattered are from 30 to less than 50.

Poor: Unusable in practice. The number of toners scattered are 50 or more.

[Fixing Property]

I. Fixing Non-Offset Range

The high-temperature offset and the low-temperature offset were defined as follows. As some toner is unfixed to the recording sheet during the fixing operation and remains on a fixing roller, the toner may be attached to the recording sheet after the fixing roller goes into a 360-degree roll with the toner. This situation was referred to as occurrence of offset.

Excellent: The fixing non-offset range covered temperatures of 60° C. and higher.

Good: The fixing non-offset range covered temperatures of 45° C. or higher and lower than 60° C.

Not bad: The fixing non-offset range covered temperatures of 35° C. or higher and lower than 45° C.

Poor: The fixing non-offset range covered temperatures lower than 35° C.

II. Low Temperature Fixability

Low temperature fixability was evaluated as that the lowest temperature in the fixing non-offset region was a fixing temperature, A toner prepared by using the same material as used in Example 1 and conducting mixing melts kneading, pulverization, classification and external addition such that a particle size is 7 μm and the content of a release agent is 5.0% was used as an evaluation standard sample. SF-1 is 163, and SF-2 is 152. The evaluation standard is as follows.

Excellent: Fixing temperature shifts to low temperature side in 20° C. or more from that of the evaluation standard sample.

Good: Fixing temperature shifts to low temperature side in 10° C. to lower than 20° C. from that of the evaluation standard sample.

Not bad: Fixing temperature shifts to low temperature side in 0° C. to lower than 10° C. from that of the evaluation standard sample.

Poor: Fixing temperature shifts to high temperature side from that of the evaluation standard sample.

[Transfer Efficiency]

Transfer efficiency refers to a proportion of the toner transferred from the surface of the photoreceptor drum to the intermediate transfer belt in one primary transfer. The transfer efficiency was calculated by assuming an amount of toner existent on the photoreceptor drum prior to the transfer to be 100%. The amount of the toner existent on the photoreceptor drum prior to the transfer was obtained by measuring an amount of the toner suctioned by a charge quantity measuring device (trade name: 210HS-2A; manufactured by Trek Japan K.K.) In addition, an amount of the toner transferred onto the intermediate transfer belt was also obtained in the same manner. Evaluation criteria are as follows.

Excellent: The transfer efficiency is 95% or more.

Good: The transfer efficiency is 90% or more and less than 95%.

Not bad: The transfer efficiency is 85% or more and less than 90%.

Poor: The transfer efficiency is less than 85%.

[Void]

The two-component developers respectively containing the toners of Examples 1 to 19 and Comparative Examples 1 to 5 were filled to a commercially-available copier MX-2300G (trade name) manufactured by Sharp Corporation and a fixing amount was adjusted to be 0.4 mg/cm$^2$, so as to form a 3×5-isolated-dot image. The 3×5-isolated-dot image refers to an image so formed that at 600 dpi (dot per inch), adjacent dot parts among plural dot parts each having a length of three dots and a width of three dots are separated from each other by a distance of five dots. The formed image was enlarged by 100-fold using a microscope manufactured by Keyence Corporation and displayed on a monitor. Out of 70 pieces of 3×5 isolated-dot parts, number of void-occurring portions was determined. Evaluation criteria are as follows.

Excellent: The number of the void-occurring portions remains in a range of from 0 to 3.

Good: The number of the void-occurring portions remains in a range of from 4 to 6.

Not bad: The number of the void-occurring portions remains in a range of from 7 to 10.

Poor: The number of the void-occurring portions is eleven or more.

[Resolution]

A manuscript where had formed an original image of 100 μm-wide thin line was copied by the above copier under a condition that a halftone image having a image density of 0.3 and a diameter of 5 mm can be copied so that the image density remains in 0.3 or higher and 0.5 or lower. The copy image thus obtained was used as a sample for measurement. A width of thin line formed in the sample for measurement was determined by an indicator, on the basis of a monitor image which was obtained by enlarging by 100-fold the sample for measurement using a particle analyzer (trade name: LUZEX 450; manufactured by Nireco Corporation). The image density refers to an optical reflection density measured by a reflection densitometer (trade name: RD-918; manufactured by Macbeth Corporation). The thin line has irregularities and a width of the thin line thus changes depending on measurement positions. Therefore, an average value of line widths measured at plural measurement positions was calculated and determined to be a line width of the sample for measurement. A reproducibility value of the thin line was obtained by centupling a value which was calculated by dividing the line width of the sample for measurement by the line width 100 μm of the manuscript. When the reproducibility value of the thin line is closer to 100, the reproducibility of the thin line is better and the resolution is higher. Evaluation criteria are as follows.

Excellent: The reproducibility value of the thin line is 100 or more and less than 105.

Good: The reproducibility value of the thin line is 105 or more and less than 115.

Not bad: The reproducibility value of the thin line is 115 or more and less than 125.

Poor: The reproducibility value of the thin line is 125 or more.

[Comprehensive Evaluation]

Evaluation standard of the comprehensive evaluation is as follows.

Good: Very Favorable. No evaluation of "Not bad" and "Poor" are indicated in the evaluation results.

Not bad: No problem on practical use. In evaluation results, No evaluation of "Poor" is indicated, and one to two evaluations of "Not bad" are indicated.

Poor: Poor. In evaluation results, at least one evaluation of "Poor" is indicated, or three or more evaluations of "Not bad" are indicated.

The evaluation results and comprehensive evaluation results of the toners obtained in Examples 1 to 19 and Comparative Examples 1 to 5 are shown in Table 2.

TABLE 2

| | | Cleanability | | | | | | Selective development | | Dot scattering | |
|---|---|---|---|---|---|---|---|---|---|---|---|
| | | Initial | | After 10,000 copies | | After 50,000 copies | | Variation in | | | |
| | Flowability Bulk specific gravity | Amount of fogging Wk (%) | Evaluation | Amount of fogging Wk (%) | Evaluation | Amount of fogging Wk (%) | Evaluation | volume average particle size | Evaluation | Value of dot scattering | Evaluation |
| Ex. 1 | 0.36 | 2 | Excellent | 2 | Excellent | 3 | Good | 0.05 | Excellent | 20 | Good |
| Ex. 2 | 0.35 | 2 | Excellent | 2 | Excellent | 4 | Good | 0.26 | Not bad | 16 | Excellent |
| Ex. 3 | 0.35 | 2 | Excellent | 2 | Excellent | 4 | Good | 0.08 | Excellent | 24 | Good |
| Ex. 4 | 0.33 | 2 | Excellent | 3 | Good | 4 | Good | 0.03 | Excellent | 8 | Excellent |
| Ex. 5 | 0.40 | 1 | Excellent | 2 | Excellent | 3 | Good | 0.24 | Not bad | 29 | Good |
| Ex. 6 | 0.38 | 1 | Excellent | 2 | Excellent | 3 | Good | 0.19 | Good | 19 | Excellent |
| Ex. 7 | 0.35 | 2 | Excellent | 2 | Excellent | 3 | Good | 0.14 | Good | 37 | Not bad |
| Ex. 8 | 0.35 | 2 | Excellent | 8 | Not bad | 8 | Not bad | 0.13 | Good | 21 | Good |
| Ex. 9 | 0.36 | 1 | Excellent | 2 | Excellent | 3 | Good | 0.22 | Not bad | 18 | Excellent |
| Ex. 10 | 0.35 | 2 | Excellent | 7 | Not bad | 9 | Not bad | 0.04 | Excellent | 21 | Good |
| Ex. 11 | 0.34 | 2 | Excellent | 2 | Excellent | 3 | Good | 0.14 | Good | 25 | Good |
| Ex. 12 | 0.30 | 2 | Excellent | 4 | Good | 6 | Not bad | 0.05 | Excellent | 23 | Good |
| Ex. 13 | 0.35 | 1 | Excellent | 2 | Excellent | 3 | Good | 0.25 | Not bad | 23 | Good |
| Ex. 14 | 0.29 | 2 | Excellent | 8 | Not bad | 9 | Not bad | 0.16 | Good | 22 | Good |
| Ex. 15 | 0.36 | 1 | Excellent | 2 | Excellent | 3 | Good | 0.21 | Not bad | 40 | Not bad |
| Ex. 16 | 0.39 | 2 | Excellent | 2 | Excellent | 4 | Good | 0.13 | Good | 13 | Excellent |
| Ex. 17 | 0.30 | 2 | Excellent | 3 | Good | 7 | Not bad | 0.16 | Good | 23 | Good |
| Ex. 18 | 0.40 | 2 | Excellent | 2 | Excellent | 3 | Good | 0.24 | Not bad | 15 | Excellent |
| Ex. 19 | 0.25 | 2 | Excellent | 4 | Good | 7 | Not bad | 0.16 | Good | 34 | Not bad |
| Comp. Ex. 1 | 0.33 | 1 | Excellent | 3 | Good | 4 | Good | 0.34 | Poor | 49 | Not bad |
| Comp. Ex. 2 | 0.37 | 2 | Excellent | 4 | Good | 5 | Not bad | 0.15 | Good | 61 | Poor |
| Comp. Ex. 3 | 0.35 | 2 | Excellent | 4 | Not bad | 6 | Poor | 0.02 | Excellent | 33 | Not bad |
| Comp. Ex. 4 | 0.31 | 2 | Excellent | 8 | Not bad | 13 | Poor | 0.26 | Not bad | 27 | Good |
| Comp. Ex. 5 | 0.36 | 2 | Excellent | 7 | Good | 9 | Poor | 0.16 | Good | 24 | Good |

| | Fixability | | Transferability | | Image evaluation | | | | |
|---|---|---|---|---|---|---|---|---|---|
| | | | | | Void | | Resolution | | |
| | Fixing range | Low temperature fixing | Transfer efficiency | Evaluation | Number of voids generated | Evaluation | Thin line reproducibility | Evaluation | Comprehensive evaluation |
| Ex. 1 | Excellent | Good | 93 | Good | 2 | Excellent | 109 | Good | Good |
| Ex. 2 | Good | Excellent | 93 | Good | 6 | Good | 104 | Excellent | Good |
| Ex. 3 | Good | Not bad | 93 | Good | 6 | Good | 104 | Excellent | Good |
| Ex. 4 | Good | Excellent | 97 | Excellent | 5 | Good | 103 | Excellent | Good |
| Ex. 5 | Good | Not bad | 87 | Not bad | 9 | Not bad | 118 | Not bad | Not bad |
| Ex. 6 | Good | Good | 92 | Good | 6 | Good | 114 | Good | Good |
| Ex. 7 | Excellent | Not bad | 92 | Good | 8 | Not bad | 110 | Good | Good |
| Ex. 8 | Good | Excellent | 96 | Excellent | 4 | Good | 102 | Excellent | Good |
| Ex. 9 | Good | Good | 90 | Good | 9 | Not bad | 123 | Not bad | Good |
| Ex. 10 | Good | Excellent | 95 | Excellent | 4 | Good | 102 | Excellent | Good |

TABLE 2-continued

| | | | | | | | | | |
|---|---|---|---|---|---|---|---|---|---|
| Ex. 11 | Good | Good | 91 | Good | 9 | Not bad | 121 | Not bad | Good |
| Ex. 12 | Excellent | Excellent | 93 | Good | 2 | Excellent | 102 | Excellent | Good |
| Ex. 13 | Good | Not bad | 87 | Not bad | 9 | Not bad | 117 | Not bad | Not bad |
| Ex. 14 | Good | Excellent | 92 | Good | 1 | Excellent | 102 | Excellent | Good |
| Ex. 15 | Not bad | Not bad | 87 | Not bad | 9 | Not bad | 121 | Not bad | Not bad |
| Ex. 16 | Good | Excellent | 95 | Excellent | 6 | Good | 109 | Good | Good |
| Ex. 17 | Excellent | Good | 89 | Not bad | 9 | Not bad | 109 | Good | Good |
| Ex. 18 | Not bad | Excellent | 93 | Good | 5 | Good | 108 | Good | Good |
| Ex. 19 | Excellent | Good | 88 | Not bad | 9 | Not bad | 109 | Good | Good |
| Comp. Ex. 1 | Good | Not bad | 86 | Not bad | 9 | Not bad | 122 | Not bad | Poor |
| Comp. Ex. 2 | Excellent | Not bad | 92 | Good | 5 | Good | 112 | Good | Poor |
| Comp. Ex. 3 | Good | Good | 96 | Excellent | 7 | Not bad | 107 | Good | Poor |
| Comp. Ex. 4 | Not bad | Excellent | 84 | Poor | 3 | Excellent | 103 | Excellent | Poor |
| Comp. Ex. 5 | Excellent | Excellent | 94 | Good | 4 | Good | 108 | Good | Poor |

As shown in Table 2, it is apparent that the toner of the invention is a toner having good cleanability and low temperature fixability, and further provided with an effect of preventing and suppressing scattering, and can form high definition and high quality images.

In present examples, a magenta toner was used as a toner. This is because C.I. pigment red 57:1 adapted for magenta was contained as colorant. Note that the colorant may be replaced by any one of the variety of colorants listed above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising a plurality of toner particles each at least containing a binder resin and a colorant, wherein (a) and (b) are satisfied with the following expressions (1) and (2):

$$0.90 \leqq (b)/(a) \leqq 1.02 \quad (1)$$

$$140 \leqq (a) \leqq 150 \quad (2)$$

where (a) represents a shape factor SF-2 showing a degree of irregularity on surfaces of toner particles having a particle size $D_{75V}$ or less, and (b) represents a shape factor SF-2 of toner particles having a particle size $D_{25V}$ or more, and wherein the toner particles have an average shape factor SF-2 of greater than 140.

2. The toner of claim 1, wherein an average shape factor SF-1 is not less than 150 and not more than 160.

3. The toner of claim 1, wherein a volume average particle size of the entire toner particles is from 4 to 8 μm.

4. The toner of claim 1, wherein the toner particles contain a release agent in an amount of from 3 to 10% by weight based on the total weight of the toner.

5. A method for producing the toner of claim 1, comprising:

a melt-kneading step of kneading a toner raw material comprising a binder resin and a colorant in a state that the binder resin is melted, thereby forming a kneaded material;

a pulverization step of pulverizing a solidified product of the kneaded material formed in the melt-kneading step to obtain a first pulverized material comprising a plurality of toner particles and a second pulverized material comprising a plurality of toner particles and having a volume average particle size of the toner particles larger than that of the first pulverized material;

a first classification step of classifying the first pulverized material obtained in the pulverization step to obtain a first toner particle group;

a spheronization step of spheronizing the toner particles constituting the second pulverized material obtained in the pulverization step;

a second classification step of classifying the second pulverized material having the spheronized toner particles to obtain a second toner particle group having a volume average particle size larger than that of the first toner particle group; and a mixing step of mixing the first toner particle group obtained in the first classification step and the second toner particle group obtained in the second classification step.

6. The method of claim 5, wherein mechanical impact force is applied to the toner particles constituting the second pulverized material to spheronize the toner particles in the spheronization step.

7. A developer comprising the toner of claim 1.

8. A two-component developer comprising the toner of claim 1 and a carrier.

* * * * *